US012715719B2

(12) United States Patent
Takechi

(10) Patent No.: US 12,715,719 B2
(45) Date of Patent: Aug. 25, 2026

(54) SHEET FEED DEVICE AND IMAGE FORMING APPARATUS

(71) Applicant: Konica Minolta, Inc., Tokyo (JP)

(72) Inventor: Taro Takechi, Kunitachi (JP)

(73) Assignee: Konica Minolta, Inc., Tokyo (JP)

( * ) Notice: Subject to any disclaimer, the term of this patent is extended or adjusted under 35 U.S.C. 154(b) by 134 days.

(21) Appl. No.: 18/737,423

(22) Filed: Jun. 7, 2024

(65) Prior Publication Data

US 2024/0417196 A1 Dec. 19, 2024

(30) Foreign Application Priority Data

Jun. 13, 2023 (JP) ..... 2023-096962

(51) Int. Cl.
*B65H 1/12* (2006.01)
*B65H 1/04* (2006.01)

(52) U.S. Cl.
CPC ..... *B65H 1/12* (2013.01); *B65H 1/04* (2013.01)

(58) Field of Classification Search
CPC ... B65H 1/04; B65H 1/12; B65H 1/14; B65H 2402/54
See application file for complete search history.

(56) References Cited

U.S. PATENT DOCUMENTS 6,283,469 B1 * 9/2001 Weber ..... B65H 1/14 271/160
6,386,534 B1 * 5/2002 Woody ..... B65H 31/10 271/213
9,233,807 B2 * 1/2016 Lo ..... B65H 1/08

FOREIGN PATENT DOCUMENTS

JP H054731 A 1/1993

* cited by examiner

*Primary Examiner* — Howard J Sanders
(74) *Attorney, Agent, or Firm* — Buchanan Ingersoll & Rooney PC

(57) ABSTRACT

Provided is a sheet feed device that sequentially feeds sheets from an uppermost sheet of a bundle of stacked sheets, the sheet feed device including: a bottom plate that supports a lower surface of the bundle of sheets; and an elastic member that is directly or indirectly disposed on the bottom plate and urges the bottom plate upward, in which the elastic member includes support force adjustment members that can adjust moment force applied to a first position of the elastic member.

9 Claims, 19 Drawing Sheets

SHEET FEED DEVICE AND IMAGE FORMING APPARATUS

The entire disclosure of Japanese patent Application No. 2023-096962, filed on Jun. 13, 2023, is incorporated herein by reference in its entirety.

TECHNICAL FIELD

The present invention relates to a sheet feed device and an image forming apparatus.

BACKGROUND OF THE INVENTION

The envelope has a flap and a fold, and its thickness is uneven. Therefore, in a case in which a large number of envelopes are stacked, the flap side of the envelopes sinks downward and the uppermost surface of the bundle of envelopes is inclined. A sheet feed device described in JPH05-004731A is known as a device which can feed such envelopes or the like having uneven thicknesses.

DESCRIPTION OF RELATED ART

The sheet feed device described in JPH05-004731A is which can feed envelopes and the like having a standard supported size. However, in the sheet feed device described in JPH05-004731A, in the case of an envelope or the like of any size other than a standard size, the weight of the envelope on the sheet feeding table is changed by a portion where the thicknesses of the envelops are not uniform, so that the bottom plate of the sheet feed tray is inclined. Therefore, the sheet feed device described in JPH05-004731A cannot level the uppermost sheet of a stack of sheets to be fed, and thus cannot feed sheets of any size.

Further, a business operator who mainly performs printing on envelopes wants to continuously print a large number of envelopes and create a product with high productivity. However, a general paper feeder unit (PFU) can feed only up to 100 envelopes stored in a sheet feed tray at a time. For every 100 envelopes printed, the business operator has to repeat sheet feeding. Therefore, there is a problem that productivity is low.

The present invention has been made in consideration of the above-described problem, and an object thereof is to provide a sheet feed device and an image forming apparatus which can feed a bundle of a large number of sheets of any size at a time.

SUMMARY OF THE INVENTION

To achieve at least one of the abovementioned objects, according to an aspect of the present invention, a sheet feed device that sequentially feeds sheets from an uppermost sheet of a bundle of stacked sheets, the sheet feed device including: a bottom plate that supports a lower surface of the bundle of sheets; and an elastic member that is directly or indirectly disposed on the bottom plate and urges the bottom plate upward, in which the elastic member includes support force adjustment members that can adjust moment force applied to a first position of the elastic member, is provided.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION

Hereinafter, one or more embodiments of the present invention will be described with reference to the drawings. However, the scope of the invention is not limited to the disclosed embodiments.

Next, an embodiment of the present invention will be described in detail with reference to the drawings.

In the reference drawings. "front-rear" indicates a sheet feeding direction of the sheet 2 (the downstream side is the front, and the upstream side is the rear), and "right-left" indicates a width direction of the sheet 2 (a direction orthogonal to the sheet feeding direction and the vertical direction).

Figure 1:
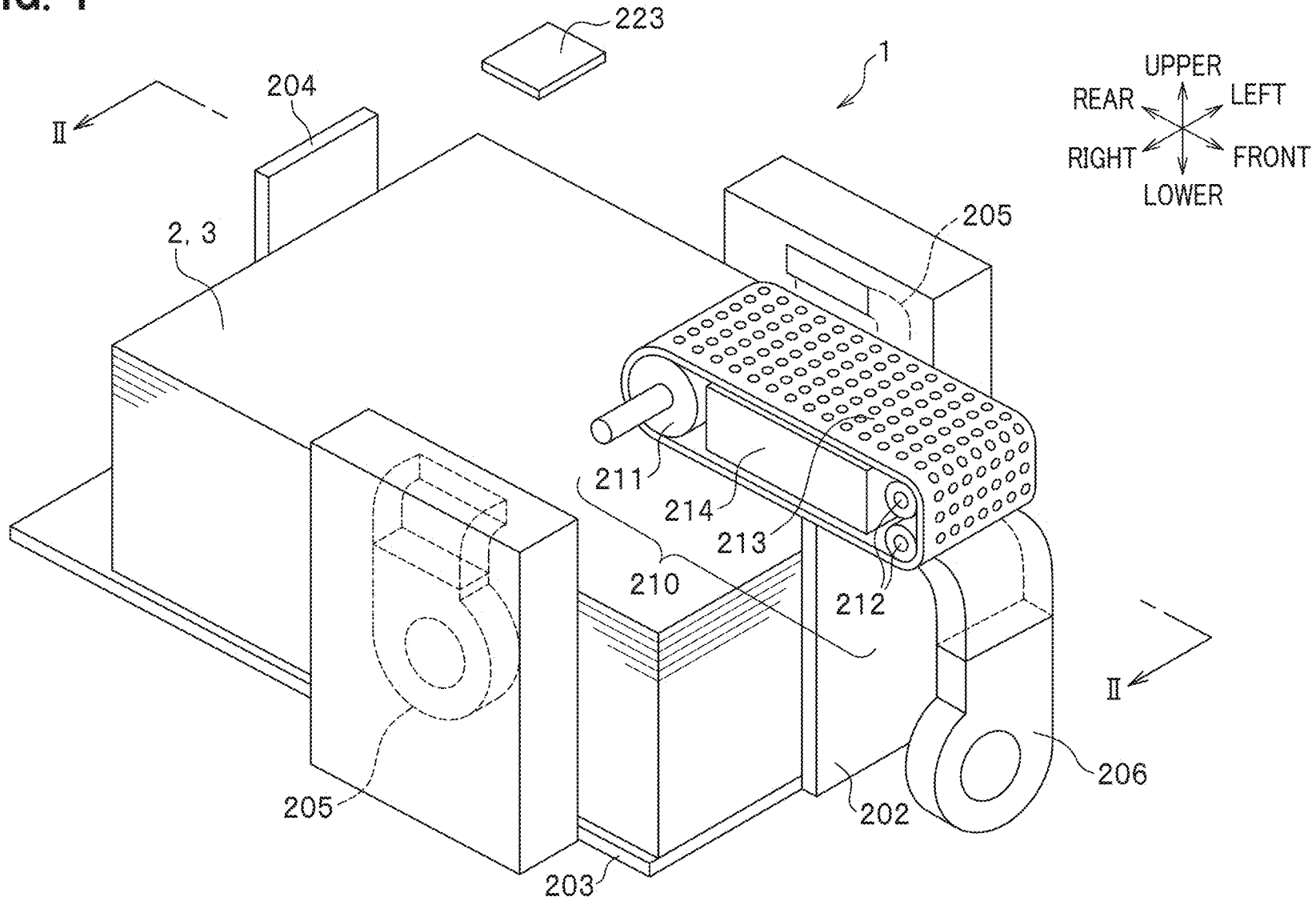
FIG. 1 is a perspective view schematically showing a sheet feed device according to an embodiment of the present invention.
Figure 2:
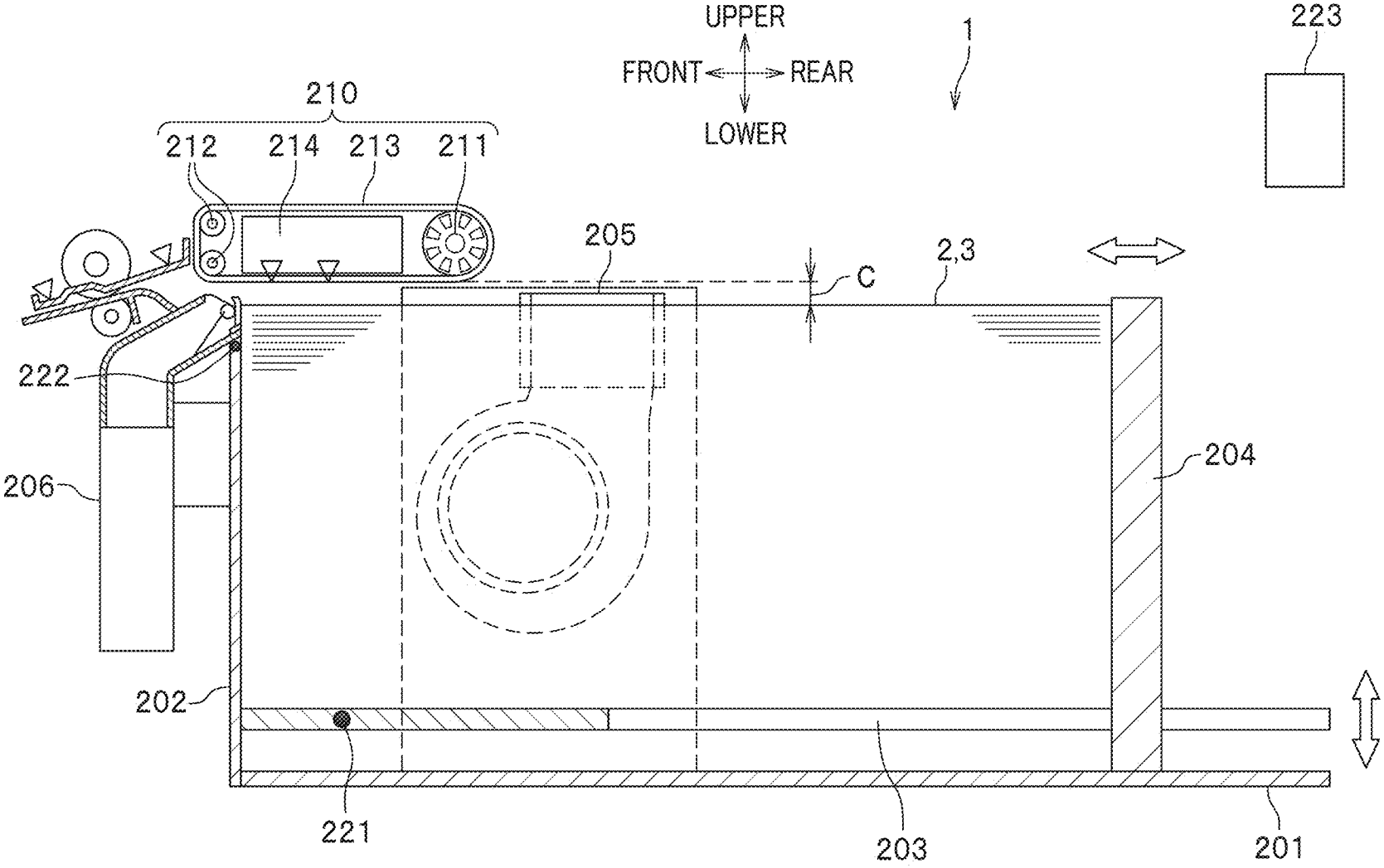
FIG. 2 is a side view (cross-sectional view taken along line II-II of FIG. 1) schematically showing the sheet feed device according to the embodiment of the present invention.

FIG. 1 is a perspective view schematically showing a sheet feed device 1 according to an embodiment of the present invention. FIG. 2 is a side view (cross-sectional view taken along line II-II of FIG. 1) schematically showing the sheet feed device 1 according to the embodiment of the present invention.

<<Sheet Feed Device>>

As shown in FIG. 1 or 2, the sheet feed device 1 according to the embodiment of the present invention is an air separation type device that blows air to a sheet 2 on the uppermost surface (top surface) of a bundle 3 of a plurality of sheets stacked in the vertical direction to make the sheet 2 to float and separate, and conveys the separated sheet 2 to supply it to the outside. As a basic configuration, the sheet feed device 1 includes a bottom plate 201 shown in FIG. 2, an elastic member SP shown in FIG. 4, a front wall 202, an lifting plate 203, a position restrict portion 204, a pair of right and left floatation parts 205 and 205, a front floatation part 206, and support force adjustment members 60 and 130 shown in FIG. 3. Furthermore, the sheet feed device 1 includes sensors 221 and 222 and a controller 223.

<<Bottom Plate>>

The bottom plate 201 supports a lower surface of the bundle 3 of sheets stored in a sheet feed tray. The bottom plate 201 extends in the horizontal direction (the front-rear direction and the left-right direction) and constitutes a floor surface of the sheet feed device 1.

<<Front Wall>>

The front wall 202 extends upward from a front end portion of the bottom plate 201. The front wall 202 is a position restrict portion that restricts a position of a distal end portion of the sheet 2 placed on the lifting plate 203 (i.e., movement of the sheet 2 toward the front).

<<Lifting Plate>>

The lifting plate 203 is provided on the upper side of the bottom plate 201, extends in the horizontal direction, and is a plate-shaped metal member movable in the vertical direction. The lifting plate 203 is formed with a hole portion, a cutout portion, and the like for allowing movement of the position restrict portion 204 and the floating portion 205.

<<Position Restrict Portion>>

The position restrict portion 204 is provided on an upper side of the bottom plate 201 so as to protrude upward from the lifting plate 203, and restricts a position of a rear end portion of the sheet 2 (i.e., rearward movement of the sheet 2) placed on the lifting plate 203. The position restrict portion 204 is manually movable relative to the bottom plate 201 in the front-rear direction, and can cope with sheets 2 of any size.

<<Right and Left Floating Portions>>

The floating portion 205 is provided on the upper side of the bottom plate 201 so as to protrude upward from the lifting plate 203, and includes a fan that blows air to the uppermost sheet of the sheets 2 placed on the lifting plate 203 from the side to lift the sheet 2. The floating portion 205 is manually movable in the right-left direction with respect to the bottom plate 201, and can cope with the sheet 2 of any size. In the pair of floating portions 205, the housing in which the fan is accommodated also functions as a position restrict portion for restricting the position of the width-direction end portion of the sheet 2 (i.e., the movement of the sheet 2 in the width direction) placed on the lifting plate 203.

<<Front Floating Portion>>

The floating portion 206 includes a fan that blows air to the uppermost sheet of the sheets 2 placed on the lifting plate 203 from the front to lift the sheet 2.

<<Sheet Feed Portion>>

The sheet feed portion 210 is provided above the front wall 202 and conveys the sheet 2 floated by the floating portion 206 In the state of being attracted by air to the outside (front) of the sheet feed device 1. The sheet feed portion 210 includes a driving roller 211 and a driven roller 212, a suction belt 213 which is an endless belt wound around the driving roller 211 and the driven roller 212 and having a plurality of holes, and a suction portion 214 provided on an inner peripheral portion of the suction belt 213.

<<Sensor>>

The sensor 221 is provided on the lifting plate 203, detects the presence or absence of the sheet 2 placed above the sensor 221, and outputs the detection result to the controller 223. The sensor 222 is provided on the upper portion of the front wall 202, detects the presence or absence of the sheet 2 existing at the same height as the sensor 222, and outputs the detection result to the controller 223.

<<Controller>>

The controller 223 is constituted by a central processing unit (CPU), a read-only memory (ROM), a random access memory (RAM), an input/output circuit, and the like. When the sheet 2 is detected by the sensor 221, the controller 223 controls a mechanism (such as a motor) (not shown) to raise the lifting plate 203. Here, when the sheet 2 is detected by the sensor 222, the controller 223 stops the mechanism to set the lifting plate 203 (i.e., the uppermost sheet 2) at a desired height. Here, the dimension of the gap C between the uppermost sheet 2 and the sheet feed portion 210 (the lower surface of the suction belt 213) is set to a predetermined value. In this state, the floating portions 205 and 206 can blow air to the uppermost sheet 2. Furthermore, the suction belt 213 is positioned above the uppermost sheet 2 by a predetermined height.

Subsequently, the controller 223 controls the floating portions 205 and 206 to float the uppermost sheet 2. In addition, the controller 223 controls the suction portion 214 to suck the floated sheet 2 and make the sheet 2 to be adsorbed by the suction belt 213 (adsorption by air), and controls a motor or the like for rotating the driving roller 211 to convey the sheet 2 adsorbed by the suction belt 213 and supply the sheet 2 to the outside of the sheet feed device 1.

Figure 3:
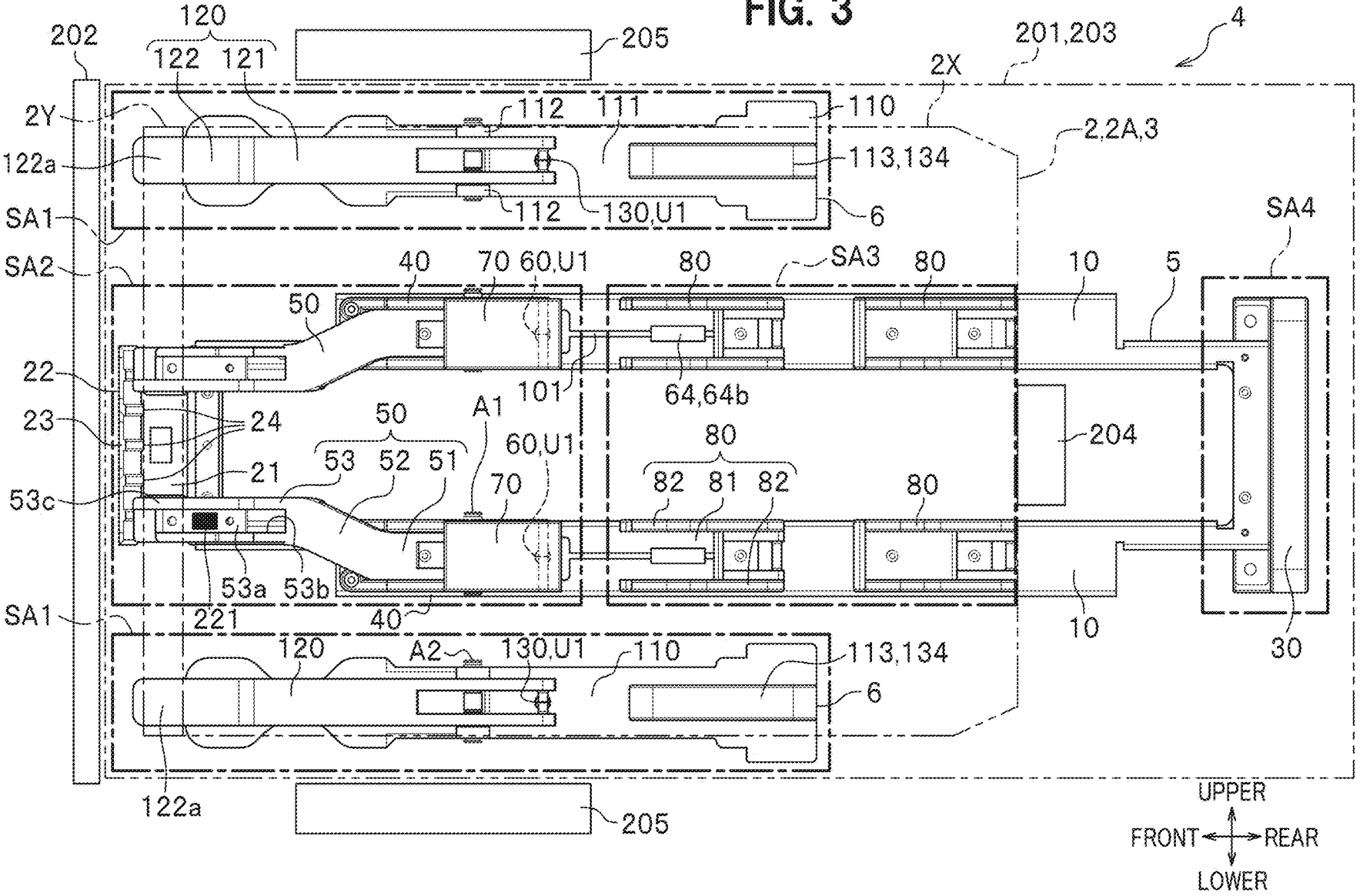
FIG. 3 is a plan view schematically showing an example of a state in which a rectangular Japanese-style envelope is supported by the sheet support base set used in the sheet feed device according to the embodiment of the present invention.
Figure 4:
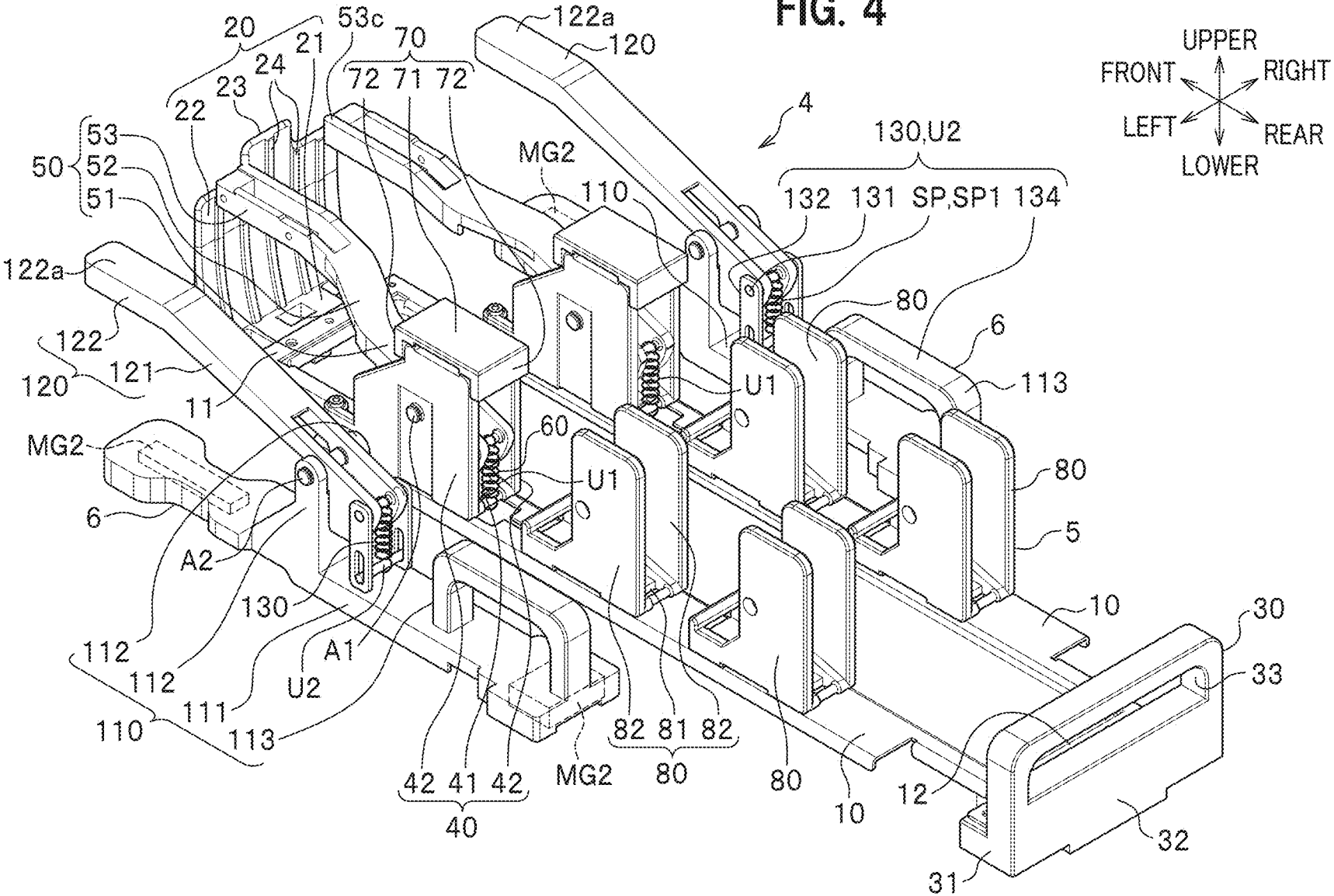
FIG. 4 is a perspective view schematically showing a sheet support base set used in the sheet feed device according to the embodiment of the present invention.

FIG. 3 is a plan view schematically showing an example of a state in which a rectangular Japanese-style envelope 2A is supported by a sheet support base set 4 used in the sheet feed device 1 according to the embodiment of the present invention. FIG. 4 is a perspective view schematically showing the sheet support base set 4 used in the sheet feed device 1 according to the embodiment of the present invention.

<Sheet Support Base Set>

As shown in FIG. 3 or 4, the sheet support base set 4 is provided on the lifting plate 203 and is used for supporting a bundle 3 which is a stacked body of a plurality of sheets 2 when the sheets 2 having partially different thicknesses such as envelopes are supplied by the sheet feed device 1. The sheet support base set 4 includes a sheet support base 5 located at the center and a pair of auxiliary sheet support bases 6 and 6 located on the right and left sides of the sheet support base 5.

As shown in FIG. 3, first support areas SA1 and SA1, a second support area SA2, a third support area SA3, and a fourth support area SA4 are arranged in the sheet support base set 4.

The first support regions SA1 and SA1 support the bundle 3 by support portions 120 and 120 of the right and left auxiliary sheet support bases 6 and 6. The first support areas SA1 and SA1 support a wide envelope such as a Japanese-style rectangular No. 2 envelope 2A or a Western-style rectangular No. 3 envelope 2B (see FIG. 13A).

The second support region SA2 supports the bundle 3 by the second support portion 50 and a height increase portion 70 of the sheet support base 5. The third support area SA3 supports the bundle 3 by a third support portion 80 of the sheet support base 5. The fourth support region SA4 supports the bundle 3 by the connection portion 30 of the sheet support base 5. The second support region SA2, the third support region SA3, and the fourth support region SA4 can support the front and rear ends of any size of envelop.

<<Sheet Support Base>>

As shown in FIG. 3 or 4, the sheet support base 5 includes a pair of base portions 10 and 10, a position restrict portion 20, and a connection portion 30. Furthermore, the sheet support base 5 includes, for each base portion 10, a first support portion 40, a second support portion 50, a support force adjustment member 60, the height increase portion 70, and a pair of front and rear third support portions 80 and 80.

<<Base>>

The base portion 10 is a long plate-shaped metal member that extends in a sheet feeding direction of the sheet 2, that is, in the front-rear direction. The base portion 10 can be fixed to the lifting plate 203 by magnetic force. The pair of base portions 10 and 10 are provided in parallel to each other at a predetermined interval in the width direction. In the present embodiment, the pair of base portions 10 and 10 are two sides facing each other of a metal member having a rectangular frame shape. That is, front ends of the pair of base portions 10 and 10 are integrally connected to each other by a front side portion 11 extending in the right-left direction, and rear ends of the pair of base portions 10 and 10 are integrally connected to each other by a rear side portion 12 extending in the width direction.

<<Position Restrict Portion>>

Figure 5:
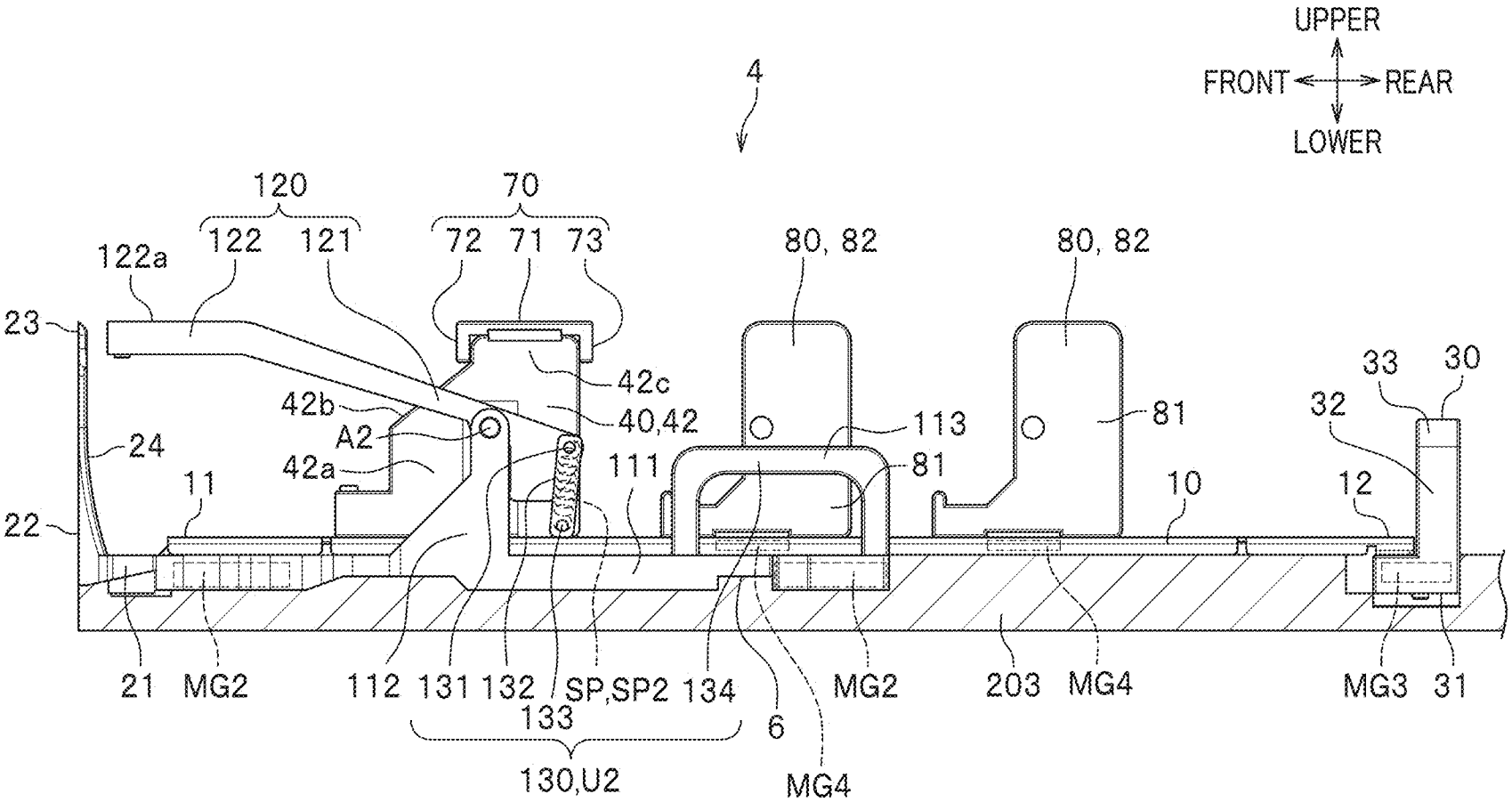
FIG. 5 is a side view schematically showing a sheet support base set used in the sheet feed device according to the embodiment of the present invention.

The position restrict portion 20 is a resin member that connects the front ends of the pair of base portions 10 and 10 to each other and restricts the position of the front end portion of the bundle 3 which is a stacked body of the plurality of sheets 2 supported by the sheet support base 5. The position restrict portion 20 includes a bottom wall 21 provided at a bottom portion, a front wall 22 extending upward from a front end portion of the bottom wall 21, and an extending wall 23 extending upward from a widthwise intermediate portion of an upper end portion of the front wall 22. A rear end portion of the bottom wall 21 is fixed to front ends of the pair of base portions 10 and 10 and the front side portion 11. As shown in FIG. 5, the rear surfaces of the front wall 22 and the extending wall 23 have arc shape about the rotation axes A1 and A2 in a side view.

Further, the position restrict portion 20 includes a plurality of ribs 24 standing rearward from the rear surfaces of the front wall 22 and the extending wall 23. The ribs 24 extend in the vertical direction, and the plurality of ribs 24 are disposed at equal intervals in the width direction. As shown in FIG. 5, the distal end portion (rear end surface) of the rib 24 has an arc shape about the rotation axes A1 and A2 in a side view.

<<Connection Portion>>

The connection portion 30 is a resin member that connects rear ends of the pair of base portions 10 and 10 to each other. The connection portion 30 includes a bottom wall 31 and a rear wall 32 extending upward from a rear end portion of the bottom wall 31. A front end portion of the bottom wall 31 is removably fixed to rear ends of the pair of base portions 10 and 10 and the rear side portion 12 by a magnet MG3 (see FIG. 5) or a screw (not shown). A handle portion 33 is formed at an upper part of the rear wall 32. The handle portion 33 has a hole portion that penetrates the rear wall 32 in the front-rear direction, and is held by a user.

The connection portion 30 includes a lower protrusion extending downward from the bottom wall 31. The lower protrusion is fitted into a groove extending in the front-rear direction at the center in the width direction of the lifting plate 203, thereby restricting the movement of the connection portion 30 in the width direction and positioning the sheet support base 5 in the width direction.

<<First Support Portion>>

The first support portion 40 is a resin member including a bottom wall 41 and a pair of side walls 42 and 42 extending upward from both ends of the bottom wall 41 in the width direction. The bottom wall 41 is formed to have substantially the same width dimension as the base portion 10, and is attached to an intermediate portion of the base portion 10 in the longitudinal direction. The first support portion 40 supports, on the upper surfaces of the side walls 42, a portion of the bundle 3 on which the thin portions 2X (see FIGS. 10A to 10C) of the sheets 2 are stacked.

FIG. 5 is a side view schematically showing the sheet support base set 4 used in the sheet feed device 1 according to the embodiment of the present invention.

As shown in FIG. 5, the sidewall 42 includes a lower side 42*a* which is wide in the front-rear direction, an inclined side 42*b* which extends upward from an upper end portion of the lower side 42*a* and becomes narrower toward the rear direction as it goes upward, and an upper side 42*c* which extends upward from the inclined side 42*b* and becomes narrower in the front-rear direction than the lower side 42*a*. The inclined side 42*b* avoids interference with an intermediate portion 52 of the second support portion 50 described later (see FIGS. 3 and 4). The height increase portion 70 which will be described later is mounted on the upper portion 42*c*.

<<Second Support Portion>>

As shown in FIG. 3 or 4, when the bundle 3 accommodated in the sheet feed tray is supported from below, the second support portion 50 mainly supports the load of the bundle 3. The second support portion 50 is a resin member that extends in the front-rear direction, includes a base end portion 51, an intermediate portion 52, and a distal end portion 53 in this order from the rear, and has an inverted concave shape in a vertical cross-sectional view.

The base end portion 51 is accommodated between the pair of side walls 42 and 42, and is rotatably supported by the pair of side walls 42 and 42 so as to be rotatable about the rotation axis A1. In the state in which the bundle 3 is not supported, the base end portion 51 inclines upward as it goes in the front direction in a side view.

In the state in which the bundle 3 is not supported, the intermediate portion 52 inclines upward as ti goes in the front direction in a side view. Further, the intermediate portion 52 is inclined inward in the width direction as it goes in the front direction in a plan view.

In the state in which the bundle 3 is not supported, the distal end portion 53 extends in a substantially horizontal direction in a side view. On the upper surface of the distal end portion 53, the second support portion 50 supports a portion of the bundle 3 on which the thick portions 2Y (see FIGS. 10A to 10C) of the sheets 2 are stacked. In addition, In the state in which the bundle 3 is not supported, the first support portion 40 and/or the second support portion 50 is provided with a support block 54 that restricts the rotation of the second support portion 50 such that the distal end portion 53 moves upward from the horizontal level.

The distal end portion 53 includes a sensor holding portion 53*a* that is a recessed portion which can hold a sensor 221 (see FIG. 2), a through hole portion 53*b* formed in a bottom surface of the sensor holding portion 53*a*, and a sheet stacking portion 53*c* that supports the placed bundle 3 from below. The sensor 221 can be attached to and detached from each of the lifting plate 203 and the sensor holding portion 53*a* of the distal end portion 53 (see FIG. 2). The sensor 221 accommodated and held in the sensor holding portion 53*a* is connected to the controller 223 by a wire passing through the through hole portion 53*b* (see FIG. 2). The sheet stacking portion 53*c* is formed horizontally on an upper surface of the distal end portion 53.

Figure 6:
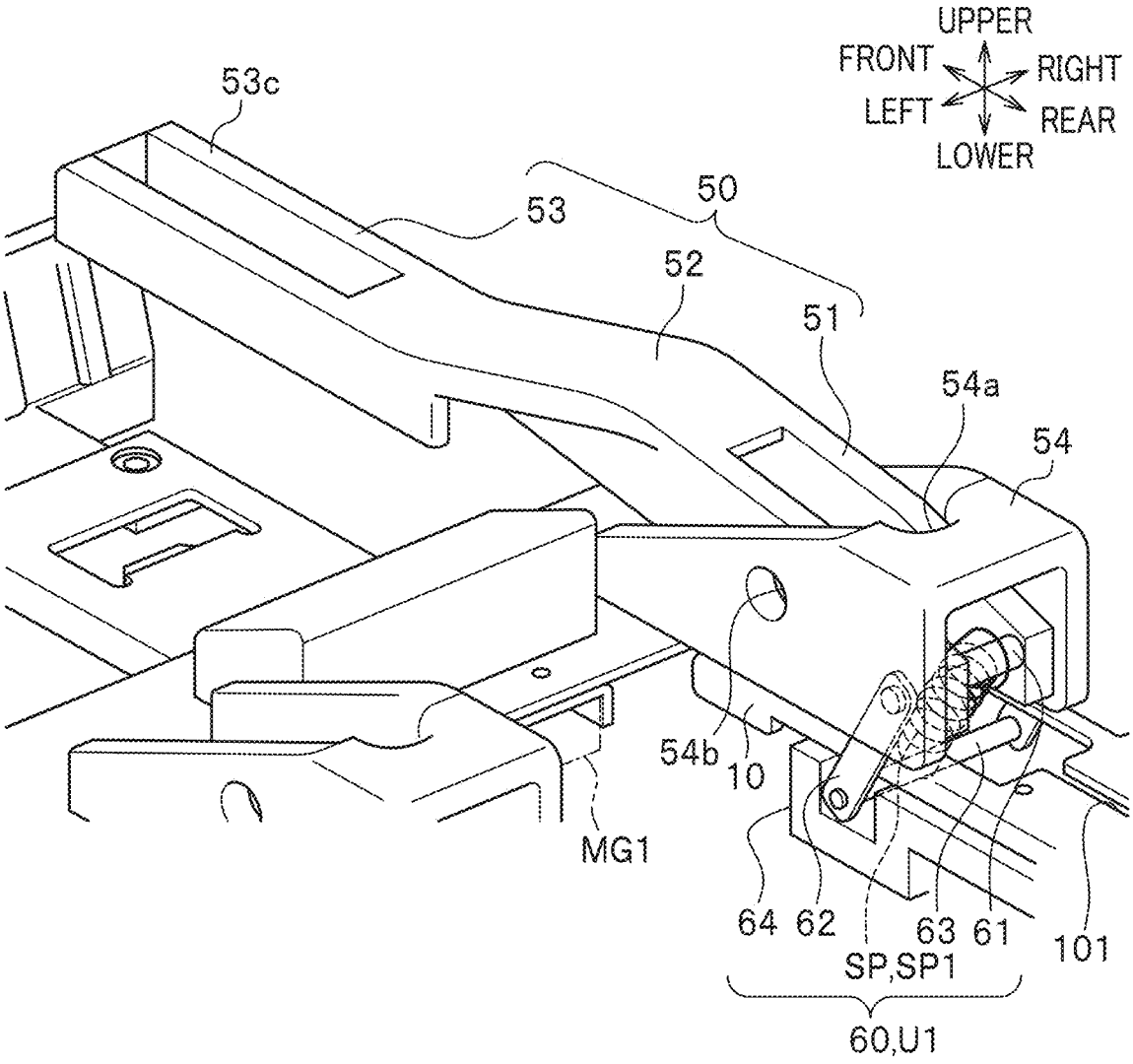
FIG. 6 is a main part perspective view showing an installation state of a support force adjustment member provided in a second support portion of the sheet support base.

FIG. 6 is a perspective view of a main portion showing an installation state of the support force adjustment member 60 provided in the second support portion 50 of the sheet support base 5.

As shown in FIG. 6, the support block 54 includes a rotation restriction portion 54*a* that restricts rotation of the second support portion 50. The support block 54 is a member having a recessed shape in a vertical cross-sectional view in which the distal end portion 53 of the second support portion 50 is fitted so as to be rotatable within a predetermined range set in advance. In the support block 54, a rotation restriction portion 54*a* and a rotation axis installation hole 54*b* through which the rotation axis A1 is inserted are formed. As shown in FIG. 4, the right and left side surfaces of the support block 54 are installed between the right and left side walls 42 and 42 of the first support portion 40 formed in an inverted recessed shape. Above the support block 54, the height increase portions 70 installed at upper ends of the side walls 42 and 42 are arranged. The support block 54 is mounted on the base 10.

<<Support Force Adjustment Member>>

The support force adjustment member 60 is a moment force adjustment member that can adjust the moment force applied to the first position of the elastic member SP that urges the bottom plate 201 (see FIG. 2) of the sheet feed device 1 in the upward direction. The support force adjustment member 60 is arranged at the base ends 51 and 51 of the second support portions 50 and 50 of the sheet support base 5. The support force adjustment member 60 is formed of a spring SP1 installed below the sheet stacking portion 53*c* on which the sheets 2 are stacked. The support force adjustment member 60 is supported by a block 64 (see FIGS. 6 and 7) installed below the sheet stacking portion 53*c*.

As shown in FIG. 3 or 4, the support force adjustment member 60 adjusts the height of the distal end portion 53 of the second support portion 50 so that the uppermost sheet 2 of the bundle 3 is within a predetermined range R (see FIG. 12B) in the vertical direction. That is, the uppermost sheet 2 has a height difference between positions in the plane thereof equal to or smaller than the predetermined range R and is substantially horizon. On the other hand, since the lowermost sheet 2 is supported by the first support portion 40 (the height increase portion 70) and the second support portion 50 having different heights, the difference in height between the positions in the plane exceeds the predetermined range R and the lowermost sheet 2 is inclined.

Figure 7:
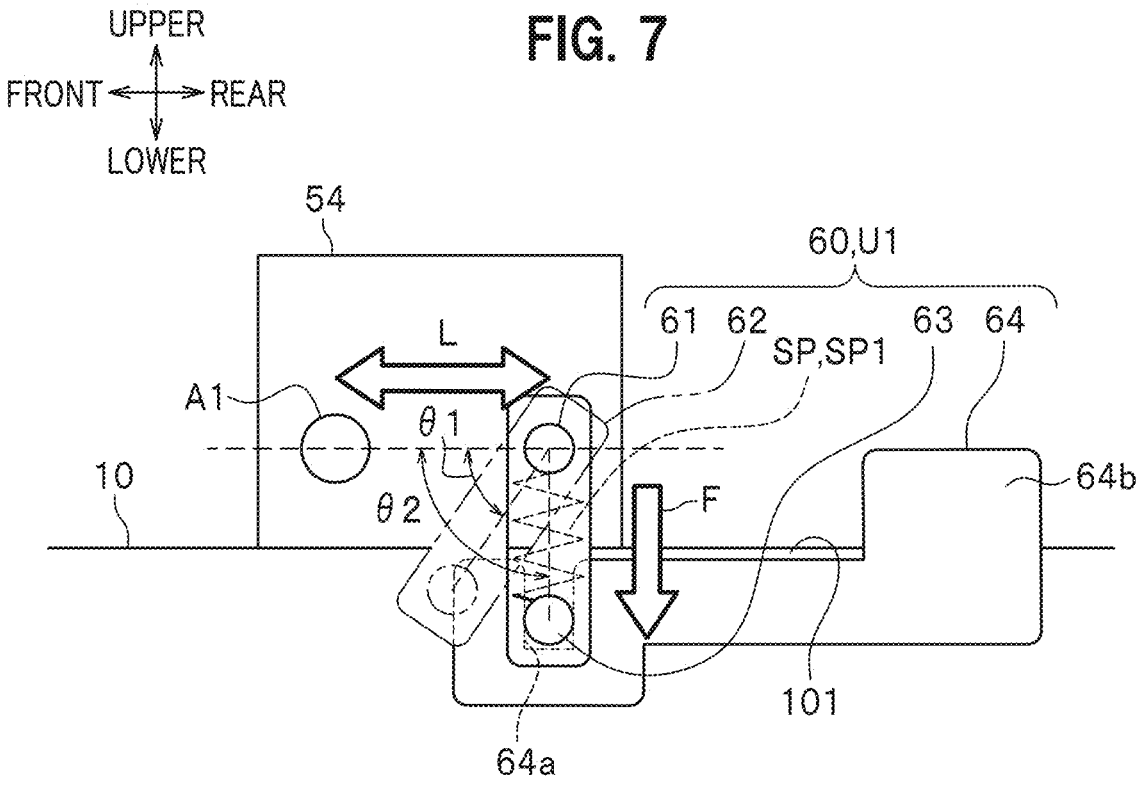
FIG. 7 is an explanatory view showing the principle of a support force adjustment member.

FIG. 7 is an explanatory view showing the principle of the support force adjustment member 60.

As shown in FIGS. 6 and 7, in the present embodiment, the support force adjustment member 60 include a support shaft 61, a pair of links 62, a connection shaft 63, a block 64, and an elastic member SP (spring SP1).

The support shaft 61 supports one end of the elastic member SP (spring SP1). The support shaft 61 is a rod-shaped member which is provided at the base end portion 51 of the second support part 50 having an inverted concave shape in a longitudinal cross-sectional view.

The links 62 are a pair of long plate-shaped link members whose upper ends are rotatably connected to both distal ends of the support shaft 61, respectively, and whose lower ends are rotatably connected to both distal ends of the connection shaft 63, respectively. Therefore, the link 62 can change the direction in which the spring SP1 acts by changing the position of the connection shaft 63 whose upper end portion swings on the support shaft 61 and whose lower end portion supports the lower end of the spring SP1. The link 62 can change the direction in which the spring SP1 acts by swinging in the front-rear direction, and thus the spring force F of the second support portion 50 can be adjusted.

A lower end portion of the spring SP1 is locked to the connection shaft 63. The connection shaft 63 is a rod-shaped member. The pair of links 62 and 62 are connected to both right and left ends of the connection shaft 63. The connection shaft 63 can change the pulling angles θ1 and θ2 of the spring SP1 with respect to the rotation axis A1 by swinging in the front-rear direction about the support shaft 61.

As shown in FIG. 7, the block 64 is a sliding member that is connected to the connection shaft 63 and moves by a distance L in the front-rear direction as the connection shaft 63 and the link 62 swing. The block 64 has a connection groove 64*a* with which the connection shaft 63 is engaged so as to be movable up and down, and a handle portion 64*b* which is held when the block 64 is moved in the front-rear direction. The block 64 can change the spring force F of the spring SP1 by changing the pulling angles $\theta_1$ and $\theta_2$ of the spring SP1 by sliding the block 64 in the front-rear direction to move the connection shaft 63 in the front-rear direction.

There are a plurality of types of blocks 64 having different heights H. That is, a plurality of blocks 64 having different heights are prepared, and the blocks 64 having different heights H are selectively set in accordance with the form of the bundle 3. The bundle 3 can be placed on the upper surface of the handle portion 64*b*. A lower end portion of the handle portion 64*b* is slidably engaged with a block slide groove 101 (see FIGS. 3 and 6) which is provided at the base portion 10 so as to extend in the front-rear direction, and is arranged so as to be guided by the block slide groove 101 to move in the front-rear direction when the link 62 swings.

<Elastic Member>

As shown in FIG. 6, the elastic member SP is an urging member that indirectly or directly urges the bottom plate 201 (see FIG. 2) upward. The elastic member SP is directly or indirectly disposed on the bottom plate 201. The elastic member SP includes a spring SP1 that is locked to the support shaft 61 and the connection shaft 63, and a spring SP2 (see FIG. 9) that will be described later. The elastic member SP is a member that elastically urges the second support portion 50 upward. The spring force F of the elastic member SP and the block 64 are changed according to the sheet 2. That is, the spring force F of the elastic member SP is preferably changed by swinging the link 62 and the connection shaft 63 in accordance with the height of the bundle 3.

<Spring>

As shown in FIG. 7, the spring SP1 is installed at an end portion of the lever-shaped second support portion 50, and the pulling angles $\theta_1$ and $\theta_2$ of the spring SP1 are changed by the support force adjustment member 60 (moving one shaft to which the spring SP1 is locked), so that the moment is adjusted. The spring SP1 is a tension coil spring for imparting resilience to the second support portion 50. As described above, the spring force F of the spring SP1 can be adjusted by changing the pulling angles $\theta_1$ and $\theta_2$.

<<Unit>>

As shown in FIG. 6, the unit U1 is formed by integrating at least the spring SP1 and the block 64. The unit U1 is removably fixed to the base 10 by the magnetic force of the magnet MG1. Therefore, the unit U1 can be replaced with one having a spring SP1 of an appropriate spring force F and a block 64 of an appropriate height.

Figure 14A:
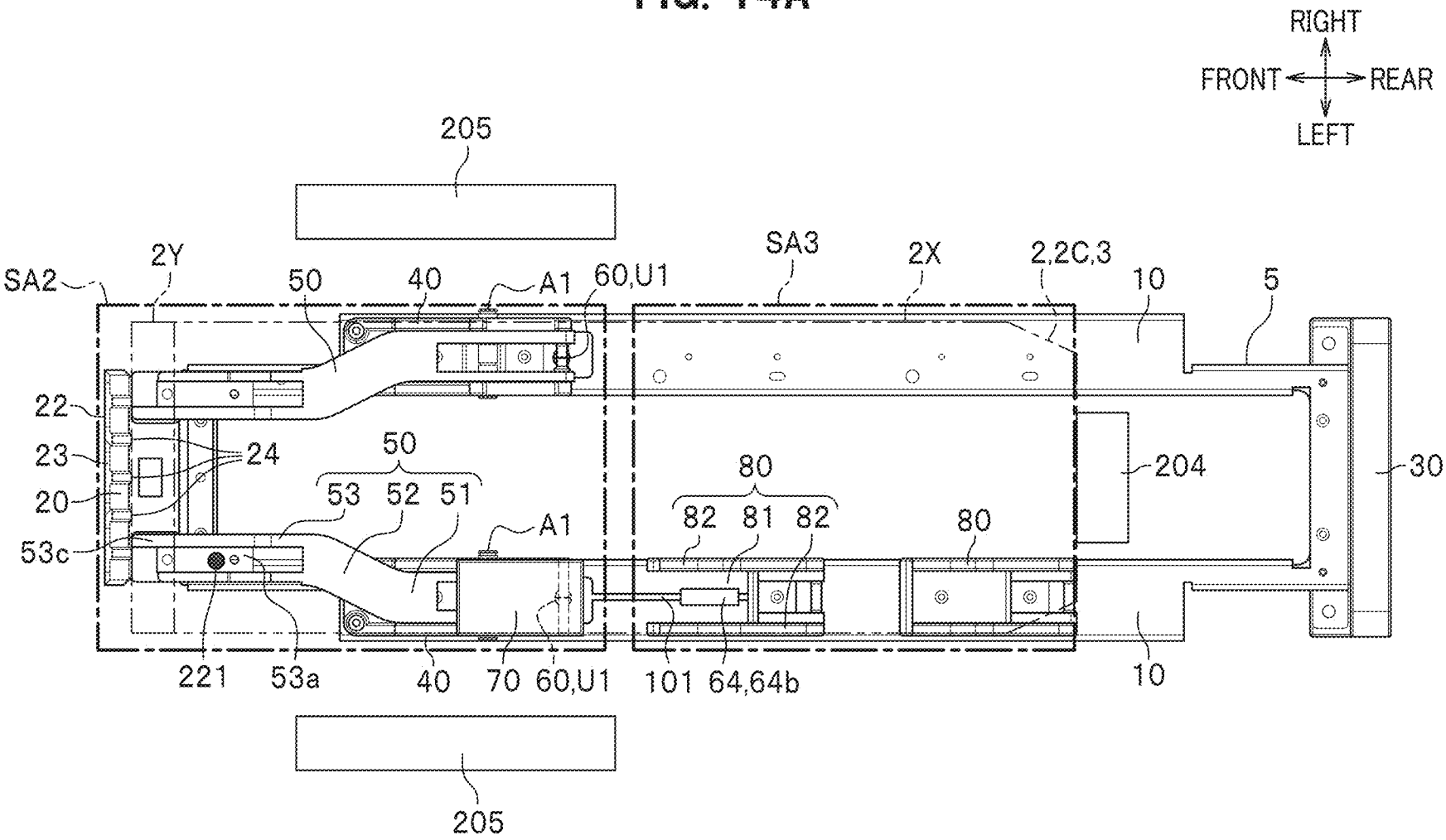
FIG. 14A is a plan view schematically showing an example of a state in which a sumi paste type long Japanese-style envelopes are supported by the sheet support base.
Figure 14B:
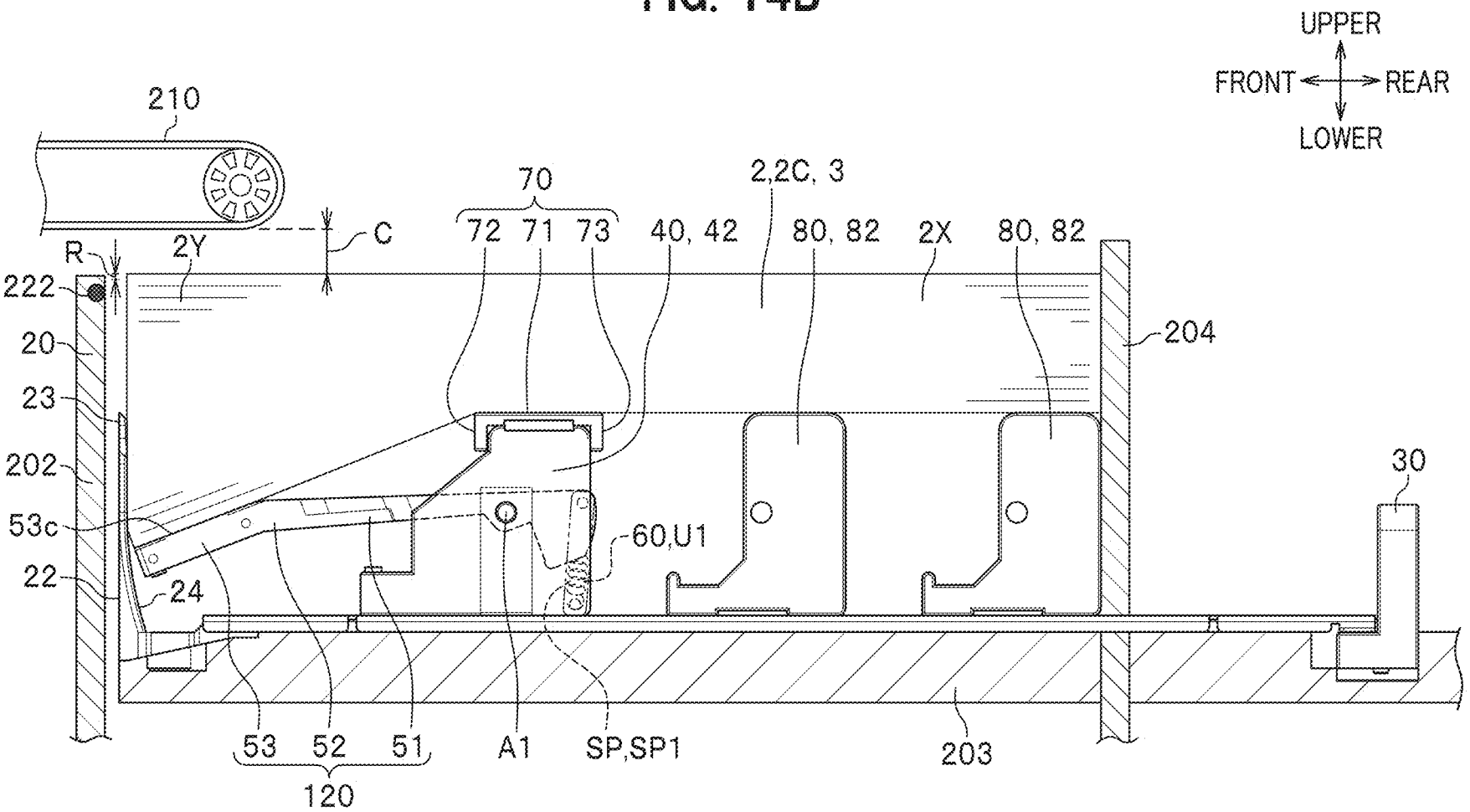
FIG. 14B is a side view schematically showing an example of a state in which sumi paste type long Japanese-style envelopes are supported by the sheet support base.

FIG. 14B is a side view schematically showing an example of a state in which a sumi paste type long Japanese-style envelope is supported by the sheet support base.

The predetermined range R shown in the FIG. 14B is a value set in advance on the basis of the thicknesses of the target sheets 2, the vertical dimensions of the paths along which the sheets 2 are supplied, and the like. In the sheet support base 5, the urging force of the support force adjustment member 60, the distance between the side wall 42 of the first support portion 40 and the distal end portion 53 of the second support portion 50, and the like are appropriately set such that the uppermost sheet 2 is within the predetermined range R (see FIGS. 3 and 4).

Figure 10A:
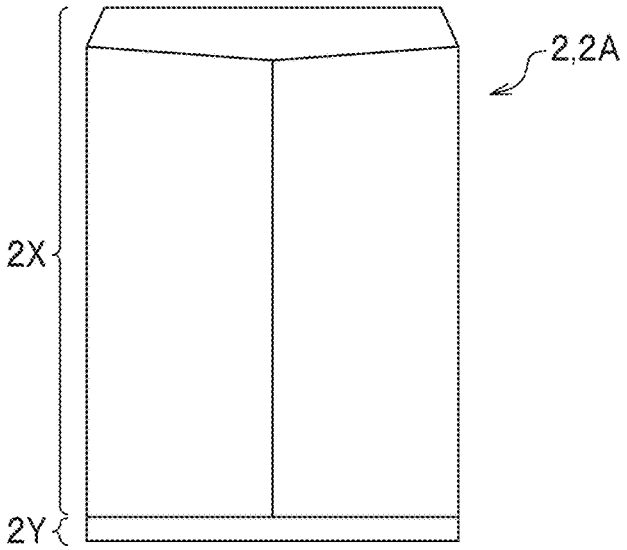
FIG. 10A is a rear view schematically showing a rectangular Japanese-style envelope as an example of the sheet.
Figure 10B:
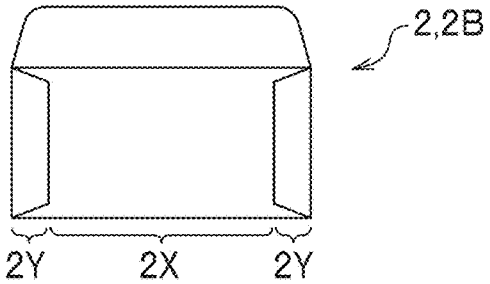
FIG. 10B is a rear view schematically showing a kamasu external paste type Western-style envelope as an example of the sheet.
Figure 10C:
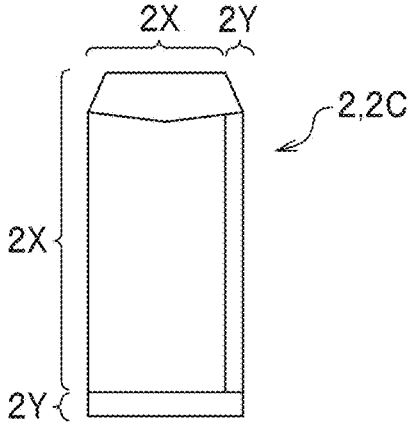
FIG. 10C is a rear view schematically showing a right-side external paste type Japanese-style envelope as an example of a sheet.

FIG. 10A is a rear view schematically showing a rectangular Japanese-style envelope 2A as an example of the sheet 2. FIG. 10B is a rear view schematically showing a kamasu external paste type Western-style envelope 2B as an example of the sheet 2. FIG. 10C is a rear view schematically showing a right-side internal paste type Japanese-style envelope 2C as an example of the sheet 2.

The support force adjustment member 60 applied as shown in FIG. 3 or FIGS. 10A to 10C adjusts the height of the distal end portion 53 of the second support portion 50 so that a difference in height between the thin portion 2X and the thick portion 2Y of the uppermost sheet 2 of the bundle 3 is smaller than a difference in height between the thin portion 2X and the thick portion 2Y of the lowermost sheet 2 of the bundle 3.

<<Height Increase Portion>>

As shown in FIG. 4, the height increase portion 70 is a resin member that is removably fixed to an upper ends of the pair of side walls 42 and 42 of the first support portion 40. The height increase portion 70 includes an upper wall 71, a front wall 72 extending downward from a front end portion of the upper wall 71, and a rear wall 73 extending downward from a rear end portion of the upper wall 71. The height increase portion 70 is fitted to the side walls 42 and 42 so as not to be movable in the front-rear direction.

<<Third Support Portion>>

As shown in FIG. 3 or 4, the third support portion 80 is a resin member including a bottom wall 81 and a pair of side walls 82 and 82 extending upward from both width-direction ends of the bottom wall 81. The bottom wall 81 is formed to be substantially as wide as the base portion 10 and is removably fixed to a longitudinally rear portion of the base portion 10 by the magnet MG4 (see FIG. 5). The third support portion 80 is provided behind the first support portion 40, and supports, on the upper surfaces of the side walls 82, a portion of the stack 3 on which the thin portions 2X of the sheets 2 are stacked (see FIGS. 3, 10A to 10C).

<<Auxiliary Sheet Support Base>>

The auxiliary sheet support base 6 is provided on the outside in the width direction of the sheet support base 5, and includes a base portion 110, a support portion 120, and a support force adjustment member 130.

<<Base>>

The base portion 110 is a resin member including an elongated plate-shaped bottom wall 111 extending in the front-rear direction, a pair of side walls 112 and 112 extending upward from both ends in the width direction at an intermediate portion in the front-rear direction of the bottom wall 111, and a handle portion 113 extending upward at a rear portion of the bottom wall 111. On a lower surface of the bottom wall 111, magnets MG2 and MG2 for removably fixing to the lifting plate 203 (see FIG. 2) by a magnetic force are mounted.

<<Support Portion>>

Figure 8:
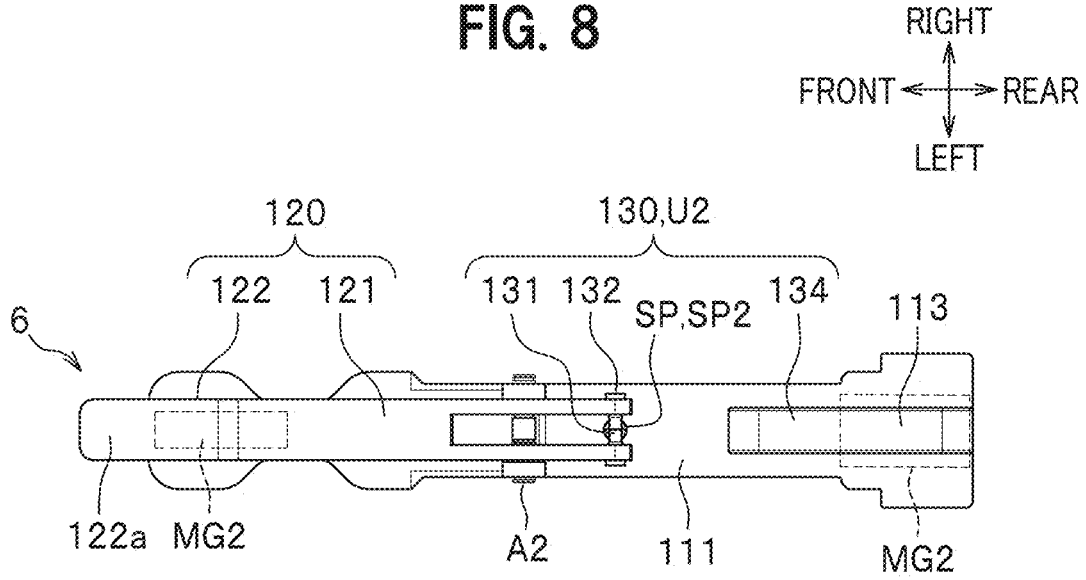
FIG. 8 is a plan view showing an installation state of the support force adjustment member provided on an auxiliary sheet support base.
Figure 9:
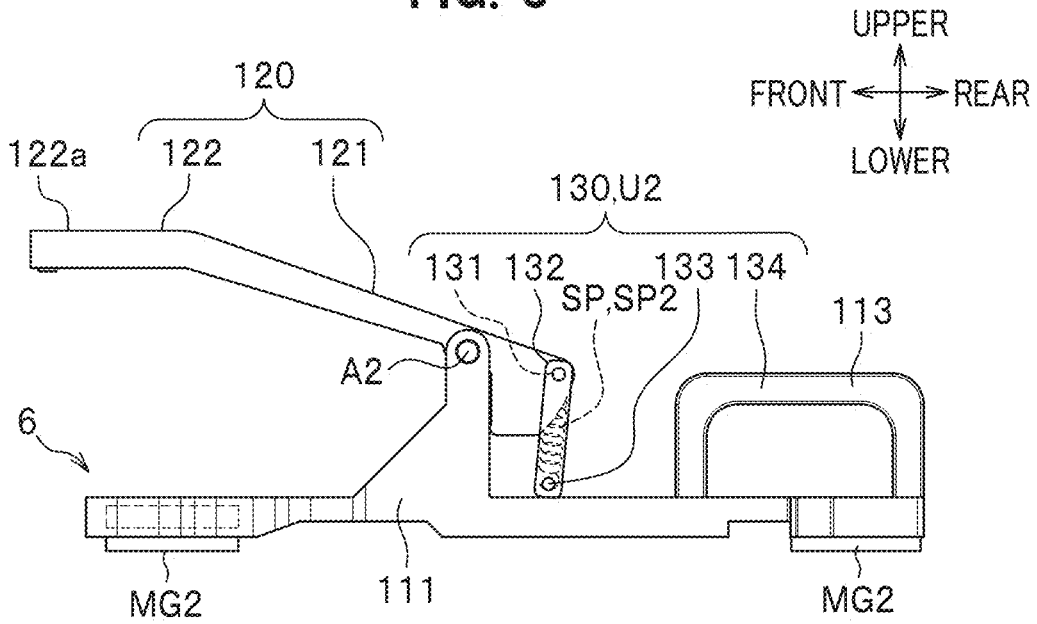
FIG. 9 is a side view showing an installation state of the support force adjustment member provided on the auxiliary sheet support base.

FIG. 8 is a plan view showing an installation state of the support force adjustment member 130 provided on the auxiliary sheet support base 6. FIG. 9 is a side view showing an installation state of the support force adjustment member 130 provided on the auxiliary sheet support base 6.

As shown in FIGS. 4, 5, 8, and 9, the support portion 120 extends in the front-rear direction, and includes a base portion 121 and a distal end portion 122 in this order from the rear. The rear end portion of the base portion 121 is accommodated between the pair of side walls 112 and 112, and is rotatably supported by the pair of side walls 112 and 112 so as to be rotatable about the rotation axis A2.

As shown in FIG. 4, in the state in which the bundle 3 (see FIG. 1) is not supported, the base portion 121 is inclined as it goes in the front direction in a side view, similar to the base end portion 51 and the intermediate portion 52 of the second support portion 50.

In the state in which the bundle 3 is not supported, the distal end portion 122 extends in a substantially horizontal direction in a side view, similar to the distal end portion 53 of the second support portion 50. The support portion 120 includes a sheet stacking portion 53*c* supporting, from below, a portion of the bundle 3 on which the thick portions 2Y of the sheets 2 are stacked, on an upper surface of the distal end portion 122 (see FIG. 3 and FIGS. 10A to 10C). In addition. In the state in which the bundle 3 (see FIG. 1) is not supported, the base portion 110 and/or the support portion 120 is provided with a rotation restrict portion that restricts the rotation of the support portion 120 such that the distal end portion 122 moves upward from the horizontal. A sheet stacking portion 122*c* is formed horizontally on the upper surface of the distal end portion 122.

<<Support Force Adjustment Member>>

As shown in FIGS. 4, 5, 8, and 9, the support force adjustment member 130 is a moment force adjustment member that can adjust the moment force applied to the first position of the elastic member SP that urges the bottom plate 201 (see FIG. 2) of the sheet feed device 1 in the upward direction, similar to the support force adjustment member 60. Furthermore, the support force adjustment member 130 adjusts the height of the distal end portion 122 of the support portion 120 so that the uppermost sheet 2 of the bundle 3 is within a predetermined range R (see FIG. 12B) in the vertical direction. The support force adjustment member 130 is an urging portion which elastically urges the sheet stacking portion 122*a* of the support portion 120 upward, and is arranged, for example, at the base portion 121 of the support portion 120 of the auxiliary sheet support bases 6 and 6. The support force adjustment member 130 is a spring SP2 installed below the sheet stacking portion 122*a* on which the sheets 2 are stacked. The support force adjustment member 130 is supported by a block 134 installed below the sheet stacking portion 122*a*.

As shown in FIGS. 8 and 9, in the present embodiment, the support force adjustment member 130 includes a support shaft 131, a pair of links 132 and 132, a connection shaft 133, the block 134, and an elastic member SP (spring SP2).

The support shaft 131 supports an upper end portion of the elastic member SP (spring SP2). The support shaft 131 is a rod-shaped member installed on the base portion 121 of the support portion 120 having an inverted concave shape in a vertical cross-sectional view.

The links 132 and 132 are a pair of long plate-shaped link members whose upper ends are rotatably connected to both distal ends of the support shaft 131 and whose lower ends are rotatably connected to both distal ends of the connection shaft 133. Therefore, the upper end portion of the link 132 swings about the support shaft 131 and the lower end portion changes the position of the connection shaft 133 supporting the lower end of the spring SP2, thereby changing the direction in which the spring SP2 acts. The link 132 can adjust the spring force F of the support portion 120 by changing the direction in which the spring SP2 acts.

The connection shaft 133 is a connecting member to which a lower end portion of the spring SP2 is locked. The connection shaft 133 is a rod-shaped member. The pair of links 132 and 132 are connected to both right and left ends of the connection shaft 133. The connection shaft 133 can change the angle of the pulling force of the spring SP2 with respect to the rotation axis A2 by swinging in the front-rear direction about the support shaft 131.

As shown in FIGS. 8 and 9, similar to the block 64 (see FIG. 7), the block 134 is a slidable member that is connected to the connection shaft 133 and moves in the front-rear direction as the connection shaft 133 and the link 132 swing. The block 64 has a connection groove (not shown) with which the connection shaft 133 is engaged so as to be vertically movable, and a handle portion 113 which can be held when the block 64 is moved in the front-rear direction and on which the bundle 3 can be placed. The block 134 is slidable back and forth to move the connection shaft 133 back and forth, thereby changing a pulling angle of the spring SP2 and thus changing the spring force of the spring SP2. There are a plurality of blocks 134 having different heights. That is, a plurality of blocks 134 having different heights are prepared, and the blocks 134 having different heights are selectively set so as to be changed in accordance with the form of the bundle 3.

<Elastic Member>

As shown in FIGS. 8 and 9, as described above, the elastic member SP includes the spring SP2 locked to the support shaft 131 and the connection shaft 133, and the spring SP1 (see FIG. 7). The elastic member SP of the support force adjustment member 130 is an urging member that elastically urges the support portion 120 upward. The spring force F of the elastic member SP and the block 134 are changed according to the sheet 2. That is, the spring force F of the elastic member SP is preferably changed by swinging the link 132 and the connection shaft 133 in accordance with the height of the bundle 3.

The spring SP2 is installed at an end of the lever-shaped support part 120, and adjusts the moment by changing an angle of the spring SP2 with the support force adjustment member 130 (by moving one shaft to which the spring SP2 is locked). The spring SP2 is a tension coil spring for imparting resilience to the support portion 120. As described above, the spring force F of the spring SP2 can be adjusted by changing the pulling angle, similar to the spring SP1 (see FIG. 7).

<Unit>

The unit U2 is, similar to the above-described unit U1, formed by integrating at least a spring SP2 and the block 134. The unit U2 is removably fixed to the base 10 by the magnetic force of the magnet MG2. Therefore, the unit U1 can be replaced with one having a spring SP1 of an appropriate spring force F and a block 64 of an appropriate height.

In this way, the support force adjusting members 60 and 130 can absorb the unbalance of the thickness of the envelope and stabilize the posture of the sheet feeding surface, so that the sheet feed device 1 can feed an envelope of any size.

<Relationship between Position and Height of Support Part>

As shown in FIG. 4 or 5, in the state in which the bundle 3 is not supported, the upper surface of the upper wall 71 of the height increase portion 70 externally fitted to the side wall 42 of the first support portion 40, the upper surface of the distal end portion 53 of the second support portion 50, the upper surface of the side wall 82 of the third support portion 80, the upper surface of the distal end portion 122 of the support portion 120, and the upper edge of the extending wall 43 are set at the same height. The distal end portion 53 of the second support portion 50 and the distal end portion 122 of the support portion 120 are located at the same position in the front-rear direction and are arranged in the width direction. The gap between the distal ends 53 of the pair of second support portions 50 and 50 is narrower than the gap between the inner side walls 42 and 42 of the pair of first support portions 40 and 40 and the gap between the inner side walls 82 and 82 of the pair of third support portions 80 and 80. In other words, the interval between the pair of first support portions 40 and 40 and the interval between the pair of third support portions 80 and 80 are set to dimensions in which the position restrict portion 204 can be arranged.

<<Sheet>>

As shown in FIGS. 10A to 10C, the sheet 2 may have a thick portion 2Y and a thin portion 2X, and the type and the like thereof are not particularly limited. The sheet 2 may be, for example, an envelope such as Japanese-style envelope 2A. 2C, or Western-style envelope 2B.

Hereinafter, a rectangular No. 2 Japanese-style envelope 2A, a Western-style No. 3 envelope 2B, and a right-side external paste type long No. 3 Japanese-style envelope 3C will be described as examples of the sheet 2.

Figure 11A:
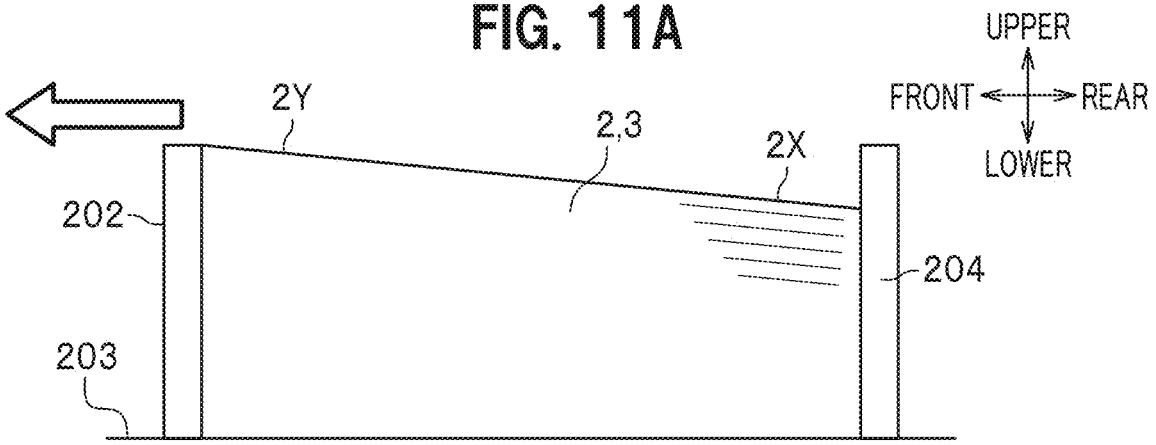
FIG. 11A is an explanatory view showing a state of envelopes stacked in a sheet feed tray of a comparative example.

FIG. 11A is an explanatory view showing a state of envelopes stacked in a sheet feed tray of a comparative example.

As shown in FIG. 11A, in the case of the sheet feed tray of the comparative example in which the bundle 3 of envelopes or the like is supported by the lifting plate 203 without using the elastic member SP and the blocks 64 and 134, when a large amount of envelopes are stacked, the uppermost surface of the thick portion 2Y side having the overlap margin becomes high, and the uppermost surface of the thin portion 2X side having the flap becomes low. Therefore, the envelope on the uppermost surface of the bundle 3 is inclined, and cannot be air-fed.

Figure 11B:
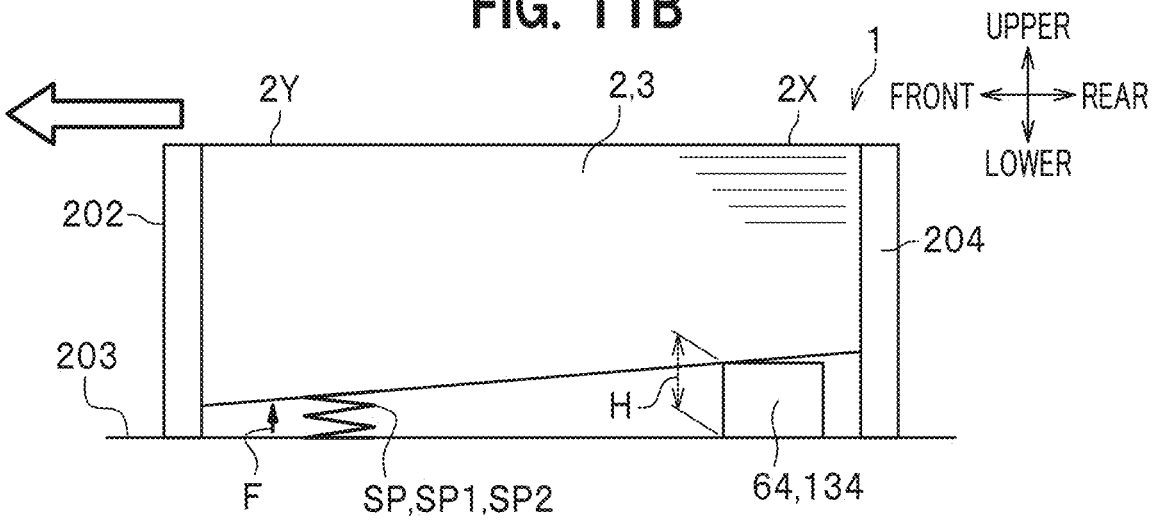
FIG. 11B is an explanatory view showing a state of long No. 3 Japanese-style envelopes and rectangular No. 2 Japanese-style envelopes stacked in the customization kit.
Figure 11C:
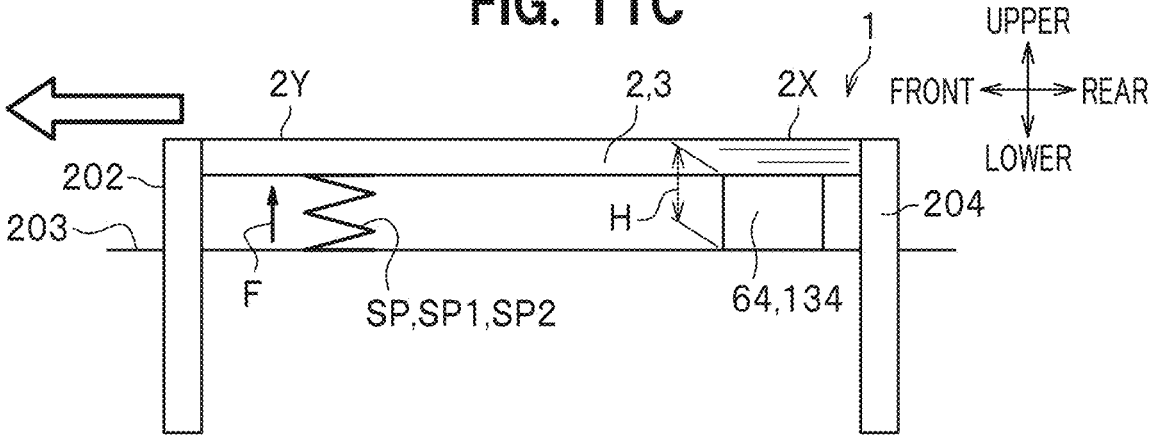
FIG. 11C is an explanatory view showing a state in which the height of the long No. 3 Japanese-style envelopes and the rectangular No. 2 Japanese-style envelopes stacked in the customization kit provided in the sheet feed tray of the present invention is lowered.

FIG. 11B is an explanatory view showing a state in which long No. 3 envelopes and rectangular No. 2 envelopes are stacked in a customization kit provided in the sheet feed tray of the present invention. FIG. 11C is an explanatory view showing a state in which the heights of the long No. 3 envelopes and the rectangular No. 2 envelopes stacked in the customization kit provided in the sheet feed tray of the present invention are lowered.

As shown in FIGS. 11B and 11C, the sheets 2 (envelopes) are stacked so as to form the bundle 3 on the lifting plate 203 of the sheet feed device 1. The uppermost sheet 2 (envelop) of the envelops (Japanese-style envelops 2A, 2C, and Western-style envelops 2B) stacked on the lifting plate 203 is horizontally disposed in order to stably air-feed the stacked envelops by the elastic member SP and the blocks 64 and 134. The elastic member SP and the blocks 64 and 134 absorb the load of the thick portion 2Y even if the uppermost surface of the bundle 3 on the side of the thick portion 2Y becomes high due to the overlapping margin of the envelopes, and the blocks 64 and 134 support the thin portion 2X having a low height, so that the uppermost envelope can be made horizontal.

Therefore, as shown in FIG. 11B, the sheets 2 accommodated in the sheet feed tray can be stacked on the lifting plate 203 such that the stack 3 is high, and therefore, the number of sheets 2 accommodated in the sheet feed tray can be significantly increased. As a result, it is possible to reduce the number of times of work and work time for placing the sheet 2 in the sheet feed tray, thereby improving productivity. Specifically, it has been verified that providing the elastic member SP and the blocks 64 and 134 in the sheet feed tray increases the upper limit of the number of sheets that can be fed to the sheet feed tray from 200 to 300.

Note that the blocks 64 and 134 need only be able to directly or indirectly support the lower surface of the bundle 3, and their shapes and materials are not limited.

<Rectangular Japanese Envelope>

As shown in FIG. 10A, in a rectangular Japanese-style envelope 2A as an example of the sheet 2, a bottom portion where a closed portion is formed by an overlapping margin is a thick portion 2Y and a portion other than the bottom portion is a thin portion 2X in a direction orthogonal to a widthwise direction.

<Kamasu External Paste Type Western-Style Envelope>

As shown in FIG. 10B, in the kamasu external paste type Western-style envelope 2B as an example of the sheet 2, both right and left sides where the closed portions are formed by the overlapping margin in the widthwise direction are thick portions 2Y, and portions other than both right and left sides are thin portions 2X.

<Sumi Paste Type Japanese-Style Envelope>

As shown in FIG. 10C, in a sumi paste type Japanese-style envelope 2C as an example of the sheet 2, a bottom portion where a closed portion is formed by an overlapping margin is a thick portion 2Y and a portion other than the bottom portion is a thin portion 2X in a direction orthogonal to a widthwise direction. Further, in the widthwise direction of the sumi paste type Japanese-style envelope 2C, an end portion where the closed portion is formed by the overlapping margin is a thick portion 2Y in a widthwise direction, and the other portion is a thin portion 2X.

<<Support Method for (Rectangular) Japanese-Style Envelope>>

Figure 12A:
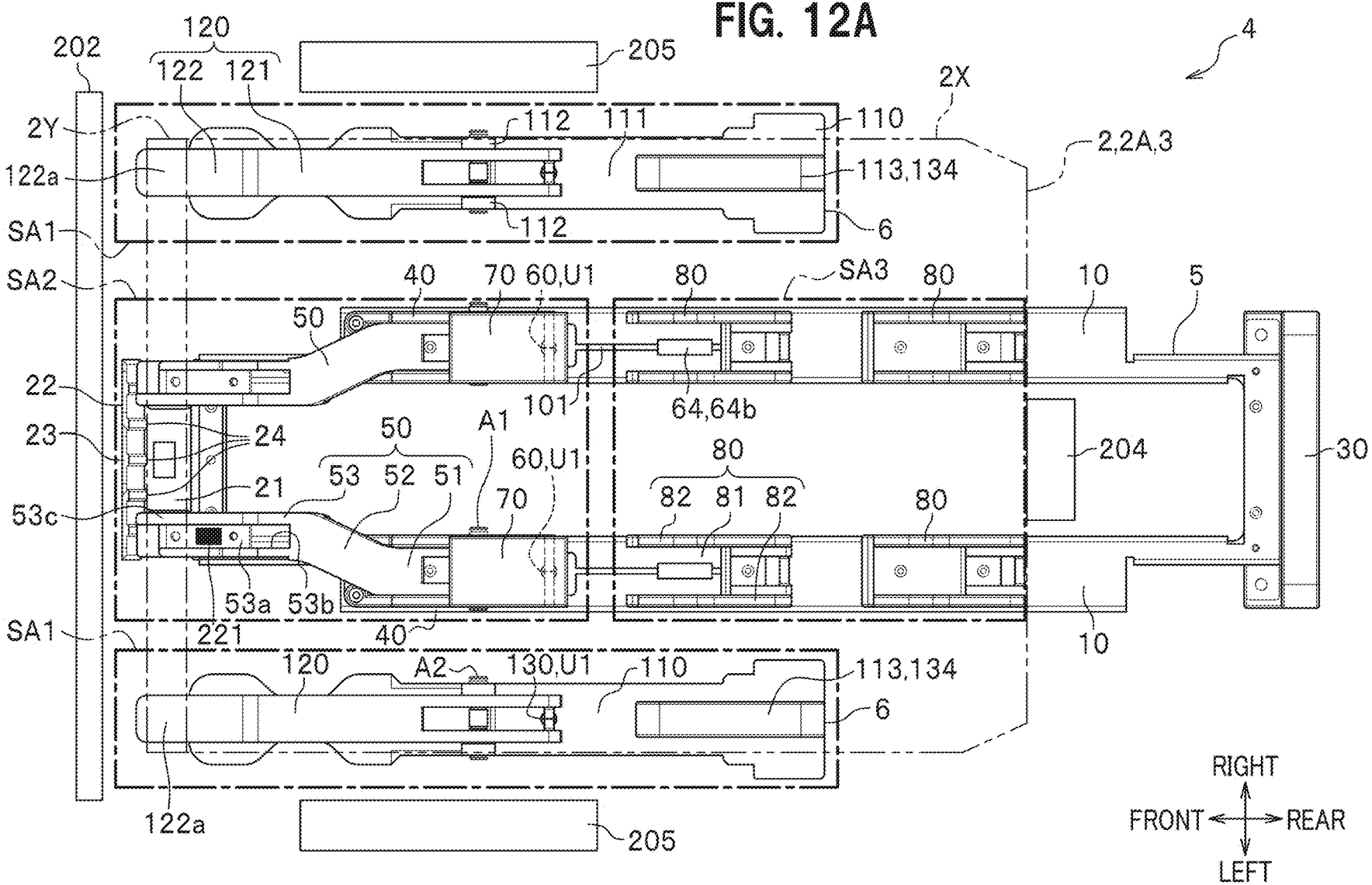
FIG. 12A is a plan view schematically showing an example of a state in which rectangular Japanese-style envelopes are supported by the sheet support base set.
Figure 12B:
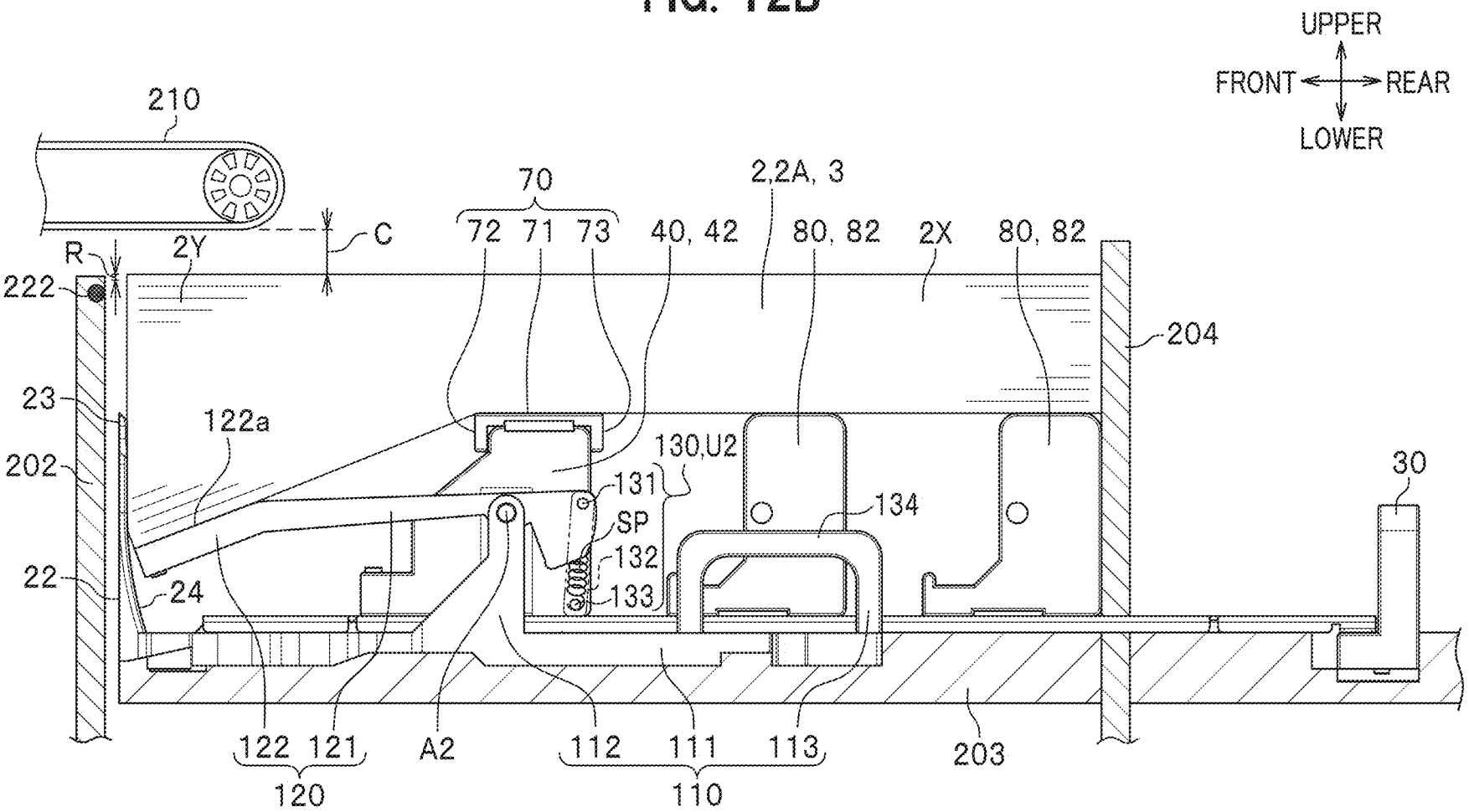
FIG. 12B is a side view schematically showing an example of a state in which rectangular Japanese-style envelopes are supported by the sheet support base set.

FIG. 12A is a plan view schematically showing an example of a state in which a rectangular Japanese-style envelope 2A is supported by the sheet support base set 4. FIG. 12B is a side view schematically showing an example of a state in which a rectangular Japanese-style envelope 2A is supported by the sheet support base set 4.

As shown in FIG. 12A or 12B, the bundle 3 of stacked rectangular Japanese-style envelopes 2A is supported by the sheet support base set 4 and is positioned by the first support portion 40, and the position restriction portion 204 and the floating portions 205 and 205 that are adjusted according to the size of the Japanese-style envelopes 2A. As shown in FIG. 12A, the bundle 3 of Japanese-style envelopes 2A is placed on and supported by the first support regions SA1 and SA1 of the right and left auxiliary sheet support bases 6 and 6 and the second support region SA2 and the third support region SA3 of the sheet support base 5.

As shown in FIG. 12A or 12B, in the bundle 3 in which the rectangular Japanese-style envelopes 2A are stacked, the portion where the thin portions 2X are stacked is placed on and supported by the upper wall 71 of the height increase portion 70 provided on the first support portion 40 and the side walls 82 and 82 of the third support portion 80. In addition, in the bundle 3 in which the rectangular Japanese-style envelopes 2A are stacked, the portion where the thick portions 2Y are stacked is placed on and supported by the distal end portion 53 of the second support portion 50 urged by the support force adjustment members 60 and 130 and the distal end portion 122 of the support portion 120.

Here, the weight of the thick portion 2Y makes the second support portion 50 to rotate about the rotation axis A1 such that the distal end portion 53 moves downward against the spring force F (see FIGS. 11B and 11C) of the support force adjustment member 60. Furthermore, due to the weight of the thick portion 2Y, the support portion 120 rotates around the rotation axis A2 such that the distal end portion 122 moves downward against the spring force F (see FIGS. 11B and 11C) of the support force adjustment member 130. In this state. (the upper surfaces of) the distal ends 53 and 122 support the portion of the bundle 3 where the thick portions 2Y are overlapped with each other, in a posture of being inclined downward as they go in the front direction in a side view.

In this state, the thick portion 2Y is located at a position lower than the thin portion 2X in the Japanese-style envelope 2A located at the bottom of the bundle 3. In the Japanese-style envelope 2A on the uppermost surface of the bundle 3, the thick portion 2Y has substantially the same height as the thin portion 2X. That is, in the uppermost Japanese-style envelope 2A, the vertical positions of the thin portion 2X and the thick portion 2Y are within the predetermined range R (substantially horizontal) (see FIG. 12B).

That is, In the state of being supported by the sheet support base set 4, a difference in height between the thin portion 2X and the thick portion 2Y of the Japanese-style envelope 2A that is the uppermost surface of the bundle 3 is smaller than a difference in height between the thin portion 2X and the thick portion 2Y of the Japanese-style envelope 2A that is the lowermost surface of the bundle 3. A gap C between the Japanese envelope 2A that is the uppermost surface of the bundle 3 and the sheet feed portion 210 is set to a predetermined value.

Figure 12C:
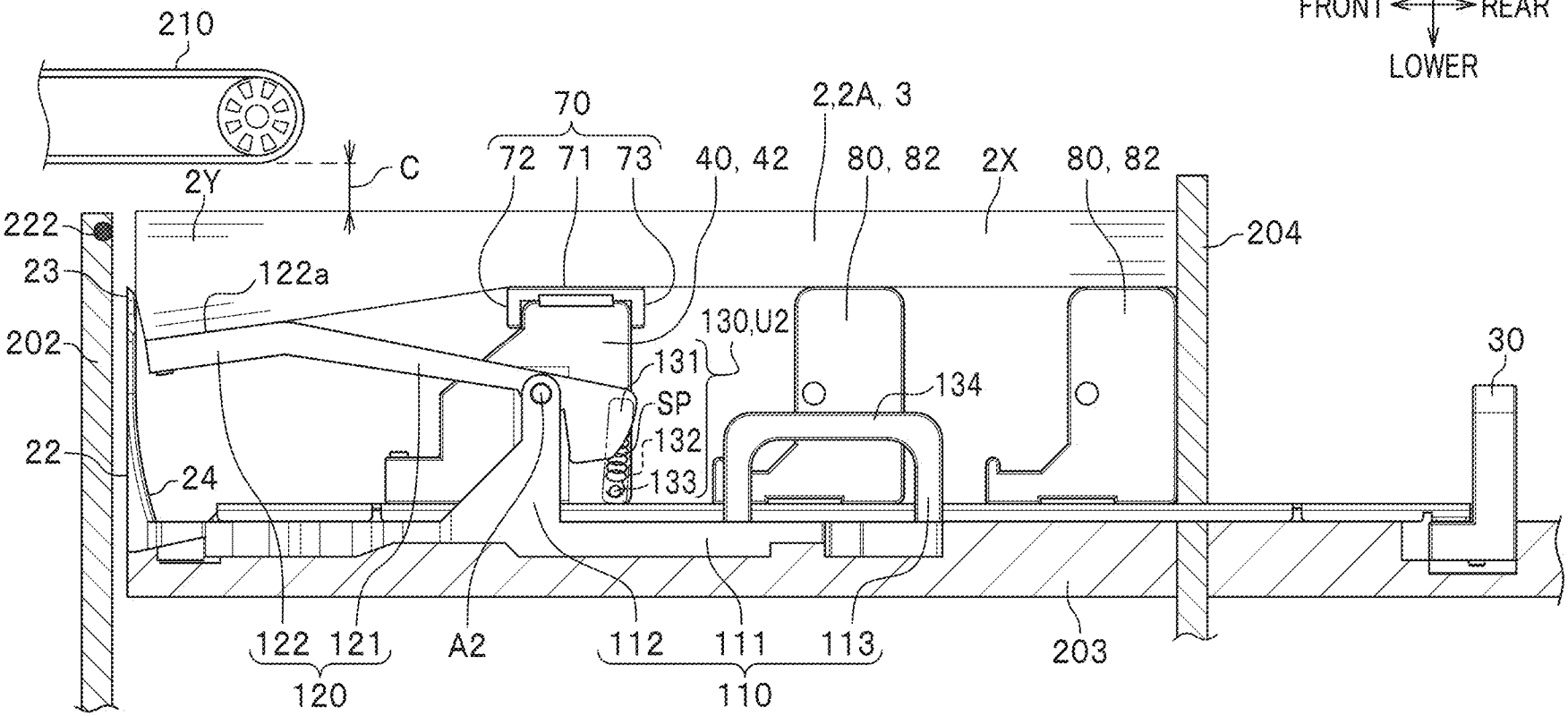
FIG. 12C is a side view schematically showing a state in which the height of the rectangular Japanese-style envelopes stacked on the sheet support base set is lowered.

FIG. 12C is a side view schematically showing a state in which the uppermost surface of the rectangular Japanese-style envelopes 2A stacked on the sheet support base set 4 is lowered.

Further, as shown in FIG. 12C, when the Japanese-style envelope 2A at the upper portion of the bundle 3 is supplied to the outside and the bundle 3 becomes thin, the controller 223 (see FIG. 1) raises the lifting plate 203. In addition, the second support portion 50 (see FIG. 10A) rotates around the rotation shaft A1 such that the distal end portion 53 moves upward due to the weight of the bundle 3 being reduced. Similarly, as the bundle 3 becomes lighter, the support portion 120 rotates about the rotation axis A2 such that the distal end portion 122 moves upward. At this time, the front end portion of the Japanese-style envelope 2A slides with respect to the rib 44. Thus, the gap C between the uppermost Japanese-style envelope 2A of the bundle 3 and the sheet feed portion 210 is maintained at a predetermined value.

Furthermore, when the number of stacked sheets of the bundle 3 is small, the right and left height increase portions 70 may be removed. In this case, the portion of the bundle 3 on which the thin portions 2X are stacked is placed on and supported by the side walls 42 and 42 of the first support portion 40.

Note that in a case in which all of the Japanese-style envelopes 2A in the bundle 3 have been supplied to the outside, the controller 223 can stop raising the lifting plate 203 by the sensor 222 detecting the elongated wall 43.

<<Method for Supporting Western-Style Envelope (Kamasu External Paste Type Western-Style Envelope)>>

Figure 13A:
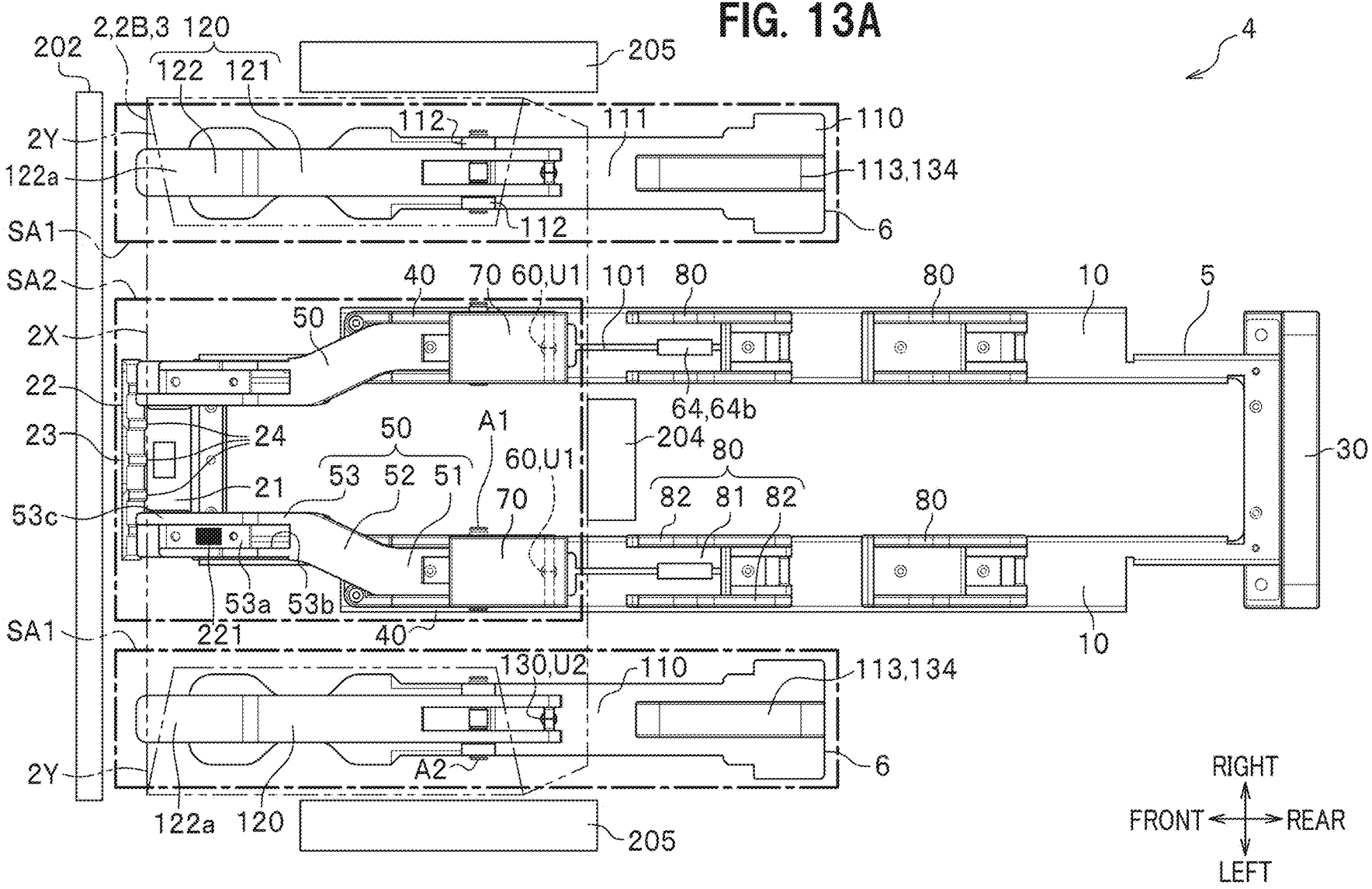
FIG. 13A is a plan view schematically showing an example of a state in which kamasu external paste type Western-style envelopes are supported by the sheet support table.
Figure 13B:
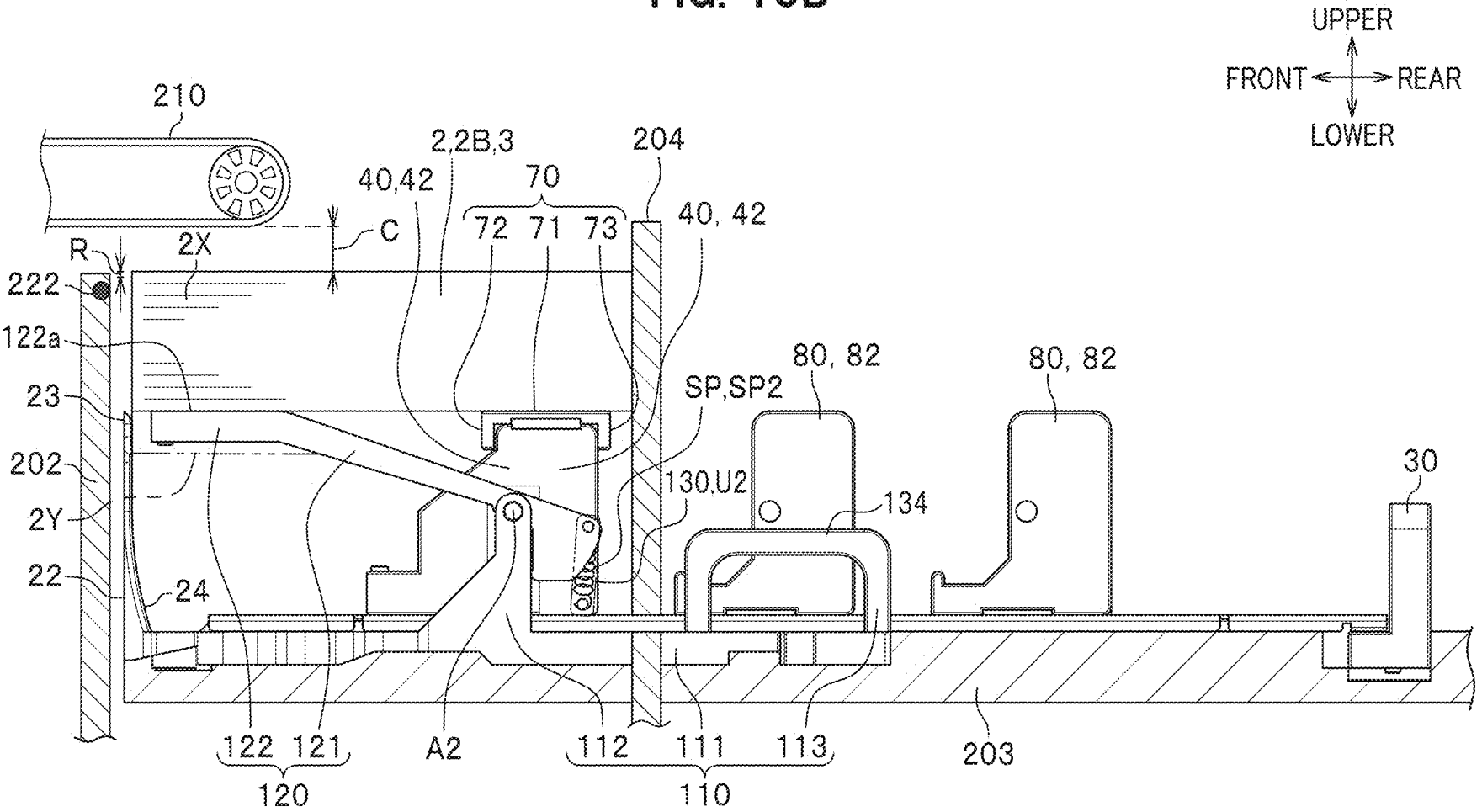
FIG. 13B is a side view schematically showing an example of a state in which the kamasu external paste type Western-style envelopes are supported by the sheet support table.

FIG. 13A is a plan view schematically showing an example of a state in which a kamasu external paste type Western-style envelope 2B is supported by the sheet support base 5. FIG. 13B is a side view schematically showing an example of a state in which a kamasu external paste type Western-style envelope 2B is supported by the sheet support base 5.

Next, a method for supporting the kamasu external paste type Western-style envelope 2B (see FIG. 13A) will be described focusing on differences from the case of supporting the rectangular Japanese-style envelope 2A. Note that in the drawings referred to in the following description, the floating portions 205 and 206 and the sheet feed portion 210 are omitted as appropriate. As shown in FIG. 13A, the bundle 3 of Western-style envelopes 2B is placed on and supported by the first support regions SA1 and SA1 of the right and left auxiliary sheet support bases 6 and 6 and the second support region SA2 of the sheet support base 5.

As shown in FIGS. 13A and 13B, the bundle 3 of stacked kamasu external paste type Western-style envelopes 2B is supported by the sheet support base 5 and is positioned by the position restriction portion 20, and the position restriction portion 204 and the floatation parts 205 and 205 that are adjusted according to the size of the Western-style envelopes 2B. In the kamasu external paste type Western-style envelope 2B, since the thick portions 2Y at both width-direction ends are positioned at the pair of right and left support portions 120 and 120 and between the pair of right and left distal ends 53 and 53, they have little influence on the posture of the Western-style envelope 2B at the uppermost surface.

<<Method for Supporting (Sumi Paste Type Long) Japanese-Style Envelope>>

Next, a method for supporting a sumi paste type long Japanese-style envelope 2C will be described. As shown in FIG. 14A, the bundle 3 of Japanese-style envelopes 2C is placed on and supported by the second support region SA2 and the third support region SA3 of the sheet support base 5. As shown in FIGS. 14A and 14B, the bundle 3 in which the sumi paste type long Japanese-style envelope 2C are stacked is supported by the sheet support base 5 and is positioned by the position restriction portion 20, and the position restriction portion 204 and the floating portions 205 and 205 that are adjusted according to the size of the Japanese-style envelope 2C. Further, in the sheet support base 5, the height increase portion 70 and the third support portion 80 on the side corresponding to the thick portion 2Y at one widthwise end of the Japanese-style envelope 2C are removed. With this configuration, the sheet support base 5 can be compatible with not only a difference in the thickness of the Japanese-style envelope 2C in the sheet feeding direction but also a difference in the thickness of the Japanese-style envelope 2C in the width direction, and can make the posture of the uppermost Japanese-style envelope 2C substantially horizontal.

As described above, since the sheet support base set 4 shown in FIG. 3 has the pair of right and left first support regions SA1 and SA1, the second support region SA2, the third support region SA3, and the fourth support region SA4, the sheet support base set 4 can place and support the bundle 3 of envelopes of any size from a large rectangular No. 0 envelope to the smallest Western-style No. 2 envelope. More specifically, an envelope having a length of 330 mm in the transverse direction and a length of 487 mm or less in the longitudinal direction can be accommodated. In that case, the envelope may be stored in either a horizontal direction or a vertical direction when the envelope can be stored in the kit.

<<Image Forming Apparatus>>

Figure 15:
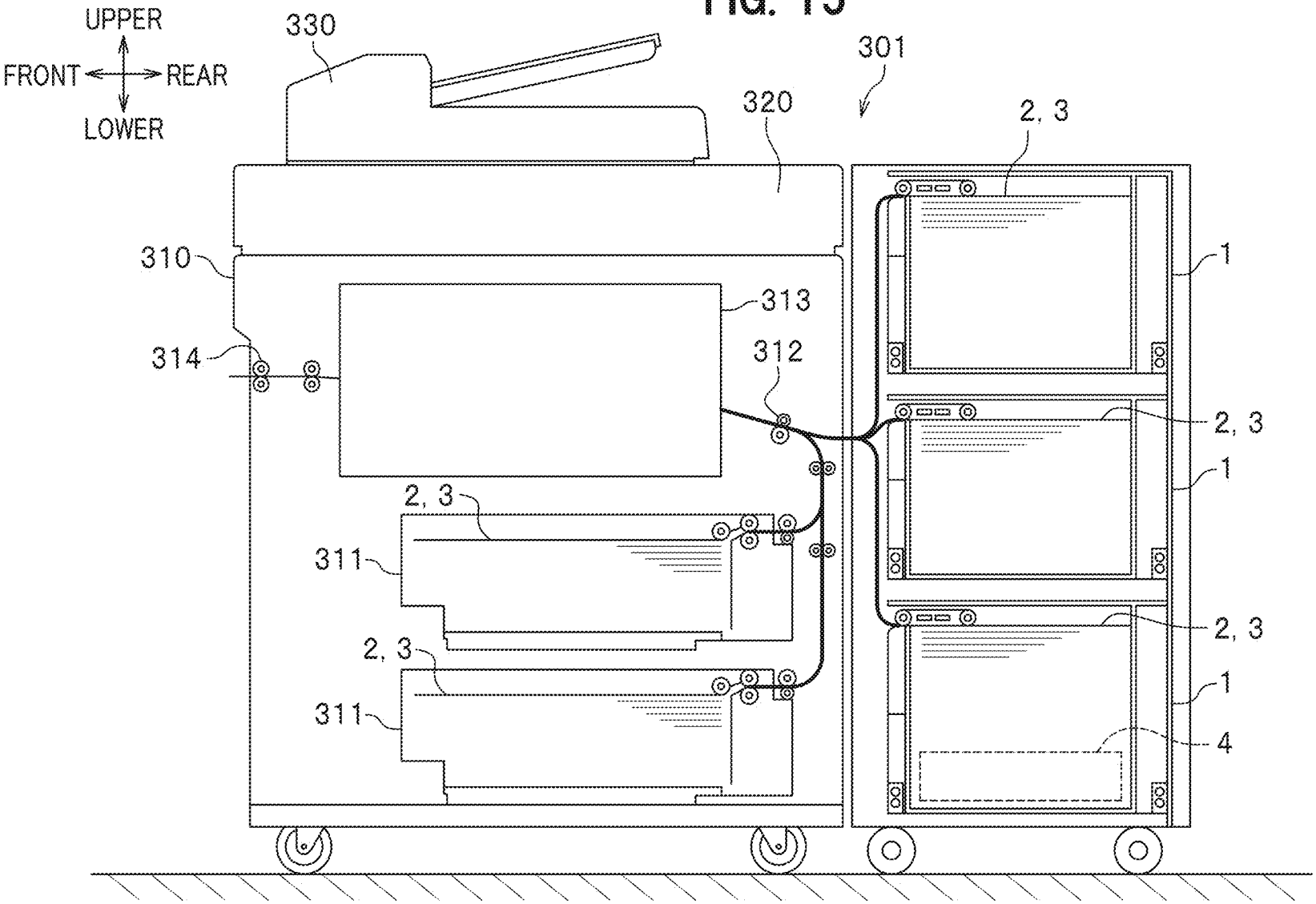
FIG. 15 is a side view schematically showing an image forming apparatus according to the embodiment of the present invention.

FIG. 15 is a side view schematically showing an image forming apparatus 301 according to the embodiment of the present invention.

The sheet feed device 1 described above is suitably used as a device for supplying the sheet 2 to the image forming apparatus 301. Examples of such an image forming apparatus 301 include a copier, a printer, a facsimile machine, a printing machine, and a multifunction peripheral. Hereinafter, a case in which the image forming apparatus 301 including the sheet feed device 1 is applied to the copier will be described as an example.

As shown in FIG. 15, the image forming apparatus 301 according to an embodiment of the present invention includes an image forming apparatus main body 310, an image reading device 320, an automatic document feeder 330, and the sheet feed device 1.

The image forming apparatus main body 310 includes, for example, an accommodation portion 311, a supply portion 312, an image forming portion 313, and an ejection portion 314. The accommodation portion 311 accommodates a bundle 3 in which a plurality of sheets 2 are stacked. The supply portion 312 takes out the sheet 2 from the accommodation portion 311 and conveys the sheet 2 to the image forming portion 313.

The image forming portion 313 is a portion for forming an image on the sheet 2 conveyed from the supply portion 312 of the sheet feed device 1, based on the image signal transmitted from the image reading device 320. As an image forming method in the image forming portion 313, for example, an electrophotographic method, an inkjet method, or the like can be used. In one example, when the image forming portion 313 uses the electrophotographic method, the image forming portion 313 includes a toner image forming portion, an intermediate transfer belt, and a fixing portion, and forms a toner image on one main surface of the sheet 2. Furthermore, when the image forming portion 313 uses the inkjet method, the image forming portion 313 includes an inkjet head and forms an ink image on one main surface of the sheet 2.

The ejection portion 314 ejects a sheet 2 having an image formed thereon by the image forming portion 313 to the outside of the image forming apparatus main body 310.

The image reading device 320 optically reads an image from the document conveyed from the automatic document feeder 330, processes a read image signal, and transmits the processed image signal to the image forming portion 313.

The automatic document feeder 330 includes a document table and conveys a document placed on the document table to the image reading device 320.

The sheet feed device 1 is connected to the image forming apparatus main body 310 and supplies the sheet 2 to the image forming apparatus main body 310. In the present embodiment, the image forming apparatus 301 includes a plurality of the sheet feed devices 1, and each of the sheet feed devices 1 separates the sheets 2 one by one, and supplies the separated sheet 2 to the supply portion 312 of the image forming apparatus main body 310.

The sheet 2 supported by the sheet support base set 4 or the sheet support base 5 is supplied to the supply portion 312 with the thick portion 2Y in front. Supplying the sheet 2 with the thick portion 2Y in front is suitable for being conveyed by the rollers in the supply portion 312, being detected by the sensor, and the like.

As shown in FIGS. 3, 11B, 11C, 12B, 12C, 13B, and 14B, the present invention is the sheet feed device 1 that sequentially feeds sheets 2 from the uppermost sheet 2 of a bundle 3 of the stacked sheets 2, including: the bottom plate 201 that supports a lower surface of the bundle 3; and the elastic member SP that is directly or indirectly disposed on the bottom plate 201 and urges the bottom plate 201 upward, in which the elastic member SP includes the support force adjustment members 60, 130 that can adjust the moment force to be applied to the first position of the elastic member SP.

According to this configuration, in the sheet feed device 1, the moment force applied to the elastic member SP that urges the bottom plate 201 upward is adjusted by the support force adjustment members 60 and 130. Thus, the spring force F can be adjusted so that the uppermost sheet 2 is horizontal, and the sheet feed device 1 can cope with the bundle 3 of sheets having different sizes and the bundle 3 of sheets having a large amount. Even if the thickness of the sheet 2 on the sheet feed stand is uneven, the sheet feed device 1 can prevent the sheet feed stand from being inclined by vertically adjusting the sheet feed stand. Therefore, even if the sheet 2 has any size, the sheet feed device 1 can flexibly absorb a change in weight unbalance due to the thickness of the envelope, and keep the sheet feed surface horizontal. Therefore, the sheet feed device 1 can always feed the sheet 2 in a stable state. As a result, the sheet feed device 1 can make one attachment to cope with various types of the sheet 2.

As shown in FIGS. 5, 6, 9, and 13B, the support force adjustment members 60 and 130 are spring 53*c* and 122*a* installed below the sheet stacking portions SP1 and SP2 on which the sheets 2 are stacked.

According to this configuration, the support force adjustment members 60 and 130 can adjust, by the springs SP1 and SP2, the support force of the sheet stacking portions 53*c* and 122*a* on which the sheets 2 are stacked.

Further, as shown in FIG. 5, 6, 7 or 9, the springs SP1 and SP2 are provided at the ends of the lever-shaped support portion 120 (second support portion 50). The moment is adjusted by changing the pulling angles $\theta_1$ and $\theta_2$, of the springs SP1 and SP2 with the support force adjustment members 60 and 130.

According to this configuration, since the pulling angles $\theta_1$ and $\theta_2$ of the springs SP1 and SP2 can be adjusted by the support force adjustment members 60 and 130, the springs SP1 and SP2 can adjust the moment of the support portion 120 (the second support portion 50). Therefore, the support portion 120 (the second support portion 50) can support the bundle 3 of the sheets 2 of any size with suitable supporting force.

As shown in FIG. 5, 6, 9, or 7, the spring forces F of the springs SP1 and SP2 can be adjusted by changing the pulling angles $\theta_1$ and $\theta_2$.

According to this configuration, the spring forces F of the springs SP1 and SP2 can be adjusted by changing the pulling angles $\theta_1$ and $\theta_2$. Since the springs SP1 and SP2 can adjust the supporting force even when the partial weights of the bundle 3 are different because the partial sizes and partial thicknesses of the bundle 3 are different, the bundle 3 of the sheets of any sizes are supported in a suitable state.

Furthermore, as shown in FIG. 6, 7, or 9, the support force adjustment members 60 and 130 are supported by the blocks 64 and 134 installed below the sheet stacking portions 53*c* and 122*a*.

According to this configuration, the support force adjustment members 60 and 130 are supported by the blocks 64 and 134 installed below the sheet stacking portions 53*c* and 122*a*. Thus, the support force adjustment members 60 and 130 can appropriately adjust the supporting force according to the weight of the bundle 3 to support the bundle 3.

Regarding the blocks 64 and 134 shown in FIGS. 11A and 11B, a plurality of blocks 64 and 134 having different heights H are prepared, and the blocks 64 and 134 having different heights H can be selectively set in accordance with the form of the bundle 3.

According to this configuration, by preparing the plurality of blocks 64 and 134 having different heights H and selecting and replacing the block 64 and 134 in accordance with the form of the bundle 3, it is possible to suitably support the sheets 2 of any size partially different in thickness.

Further, the spring forces F of the elastic members SP and the heights H of the blocks 64 and 134 shown in FIG. 11A and FIG. 11B can be changed according to the form of the sheet 2.

According to this configuration, the sheets 2 of any size can be always stably supported by changing the spring force F of the elastic member SP and the height H of the blocks 64 and 134 in accordance with the form of the sheet 2.

Furthermore, as shown in FIG. 12A, 13A, or 14A, the sheet 2 may be an envelope (Japanese-style envelope 2A, 2C, or Western-style envelope 2B).

According to this configuration, the sheet support base 5 can easily support an envelope of any size having a partially different thickness.

Further, as shown in FIG. 5, 6, or 9, the units U1 and U2 are formed by integrating the springs SP1 and SP2 and the blocks 64 and 134. The units U1 and U2 are fixed to the base portion 10 by magnetic force.

According to this configuration, since the units U1 and U2 are fixed to the base portion 10 by the magnetic force, the springs SP1 and SP2 and the blocks 64 and 134 can be attached to and detached from the base portion 10 by one touch operation. Therefore, when the size or the like of the sheet 2 is changed, the springs SP1 and SP2 and the blocks 64 and 134 can be easily replaced with the springs SP1 and SP2 and the blocks 64 and 134 adapted to the sheet 2.

Further, as shown in FIG. 11B, 11C, 12B, 13B, or 14B, the support force adjustment members 60 and 130 adjust the moment forces applied to the first positions of the elastic members SP and SP so that the envelopes (the Japanese-style envelopes 2A and 2C, and the Western-style envelope 2B) on the uppermost surface are horizontally arranged.

According to this configuration, the support force adjustment members 60 and 130 adjust the moment force applied to the first position of the elastic member SP so that the envelope is horizontally arranged, and thus it is possible to always feed the envelope even when the size or the type of the envelope is changed.

Furthermore, as shown in FIG. 15, an image forming apparatus 301 according to an embodiment of the present invention includes the sheet feed device 1 and the image forming portion 313 that forms an image on the sheet 2 supplied from the sheet feed device 1.

According to this configuration, the uppermost sheet 2 of any size on which an image is formed is supported in a suitable posture, and thus the image forming apparatus 301 can suitably supply the sheet 2 to form an image.

According to the present invention, it is possible to provide a sheet feed device and an image forming apparatus which can feed a bundle of a large number of sheets of any size at a time.

Modified Example

Although the embodiments of the present invention have been described above, the present invention is not limited to the above-described embodiments, and can be appropriately modified without departing from the sprit of the present invention. Components already described are denoted by the same reference numerals, and a description thereof will be omitted.

Figure 16:
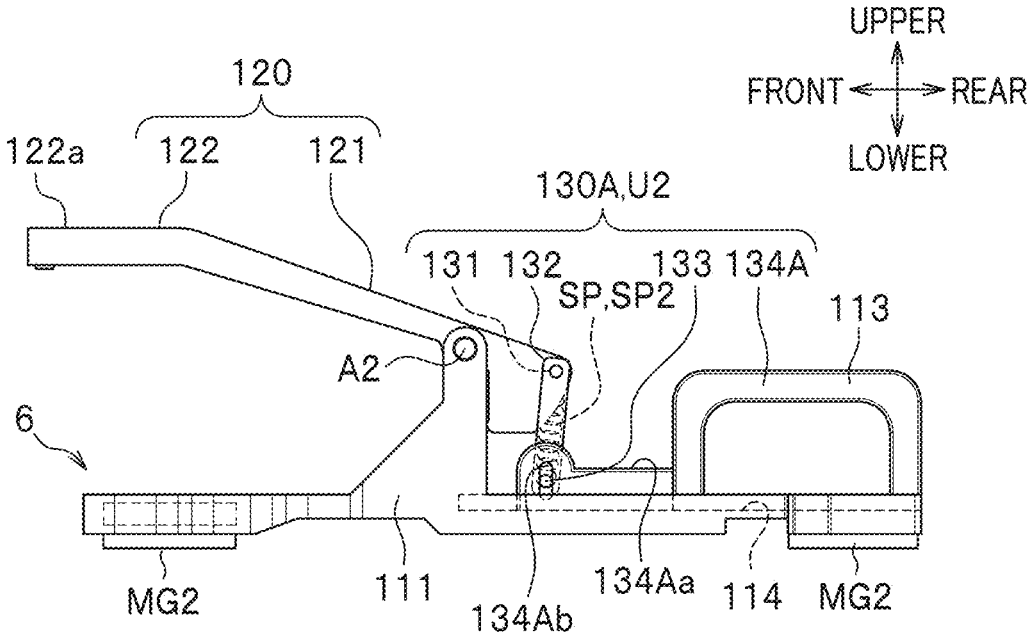
FIG. 16 is a view showing a modified example of the sheet feed device according to the embodiment of the present invention, and is a side view showing an installation state of a support force adjustment member provided in an auxiliary sheet support base.

FIG. 16 is a view showing a modified example of the sheet feed device 1 according to the embodiment of the present invention, and is a side view showing an installation state of a support force adjustment member 130A provided on the auxiliary sheet support base 6.

The block 134 of the support force adjustment member 130 shown in FIG. 9 described in the above embodiment may be configured to slide in the groove, similar to the block 64 shown in FIGS. 6 and 7.

In this case, as shown in FIG. 16, the block 134A of the support force adjustment member 130A slidably disposes a connection portion 134Aa formed integrally with the block 134A in a block slide groove 114 extending in the front-rear direction in the bottom wall 111. A long hole 134Ab is formed at the front end of the connection portion 134Aa with which the connection shaft 133 is engaged.

According to this configuration, when the handle portion 113 of the block 134A is moved in the front-rear direction, the connection portion 134Aa integrally moves in the front-rear direction to swing the link 132 in the front-rear direction. Since the pulling angle of the spring SP2 can be adjusted by swinging the link 132, the moment of the support portion 120 can be adjusted. Therefore, the support portion 120 can support the bundle 3 of the sheets 2 of any size with a suitable supporting force by moving the handle portion 113 in the front-rear direction.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet feed device that sequentially feeds sheets from an uppermost sheet of a bundle of stacked sheets, the sheet feed device comprising:

a bottom plate that supports a lower surface of the bundle of sheets; and a spring that is directly or indirectly disposed on the bottom plate and urges the bottom plate upward, wherein the spring is installed below a sheet stacking portion on which the sheets are stacked, wherein the sheet feed device further comprises a block installed below the sheet stacking portion, and wherein the spring and the block are configured to adjust moment force applied to a first position of the spring, and wherein the spring and the block are integrated as one unit, and the unit is fixed to a base portion by a magnetic force.

2. The sheet feed device according to claim 1, wherein the spring is installed at an end of a lever-shaped support part and adjusts the moment by changing an angle of the spring with a shaft to which the spring is locked.

3. The sheet feed device according to claim 1, wherein a spring force of the spring is adjusted by changing a pulling angle of the spring.

4. The sheet feed device according to claim 1, wherein the block comprises a plurality of the blocks having different heights, and the plurality of blocks having different heights are selectively set in accordance with a form of the bundle of the sheets.

5. The sheet feed device according to claim 1, wherein a spring force of the spring and a height of the block are changed in accordance with a form of the sheet.

6. The sheet feed device according to claim 1, wherein the sheet is an envelope.

7. The sheet feed device according to claim 6, wherein the block adjusts the moment force applied to a first position of the spring so that the uppermost envelope is horizontally arranged.

8. An image forming apparatus comprising:

the sheet feed device according to claim 1; and an image forming portion to form an image on a sheet supplied from the sheet feed device.

9. The sheet feed device according to claim 1, wherein the block is configured to change the spring force of the spring by changing pulling angles of the spring by sliding the block in a front-rear direction to move a connection shaft in the front-rear direction.

* * * * *